United States Patent [19]

Hu et al.

[11] Patent Number: 4,725,085

[45] Date of Patent: Feb. 16, 1988

[54] SINGLE AND DOUBLE LATCH OPERATING DEVICES WITH IMPROVED RACK-PINION OPERATION AND MOTION TRANSFER

[75] Inventors: Thomas S. S. Hu, Corona; Gary R. Bergen, Yorba Linda, both of Calif.

[73] Assignee: Kwikset Corporation, Anaheim, Calif.

[21] Appl. No.: 891,188

[22] Filed: Jul. 31, 1986

[51] Int. Cl.[4] ..... E05C 1/16

[52] U.S. Cl. ..... 292/172; 292/DIG. 26; 70/129

[58] Field of Search ..... 292/172, DIG. 26, DIG. 27, 292/160, 142, 122, 199; 70/129

[56] References Cited

U.S. PATENT DOCUMENTS

| | | | |
|---|---|---|---|
| 1,511,956 | 3/1923 | Flagg . | |
| 1,843,143 | 2/1929 | Rymer . | |
| 4,052,092 | 10/1977 | Bergen | 292/172 |
| 4,384,465 | 5/1983 | Muus | 292/DIG. 27 X |

*Primary Examiner*—Richard E. Moore

*Attorney, Agent, or Firm*—Barry E. Deutsch

[57] ABSTRACT

A novel rack-pinion forms an outside operator of either a single latchbolt or a double latchbolt with the pinion rotating a latch operator of at least a single latchbolt to move the bolt between extended and retracted positions. The rack is shiftable between pinion engaging and nonengaging positions as determined by an inside operator control button, this being the sole means of shifting in the simplist, single latchbolt form. When it is a single latchbolt form, a lock may be added to the outside operator for also shifting the rack-pinion construction. In more complex, double latchbolt form, the second bolt, preferably a deadbolt, may have an outside operator formed by a lock or an inside operator formed by a turnpiece of both. With the outside lock of the second bolt construction, a yoke may connect that to the rack-pinion construction of the first latchbolt for shifting the rack by the second latchbolt outside lock. Also, a panic assembly may be connected between the inside operator of the first latch bolt and the latch operator of the second latchbolt with either the second latchbolt outside lock or inside turnpiece or both for simultaneous operation of the second latchbolt upon operation of the first latchbolt by the inside operator.

53 Claims, 32 Drawing Figures

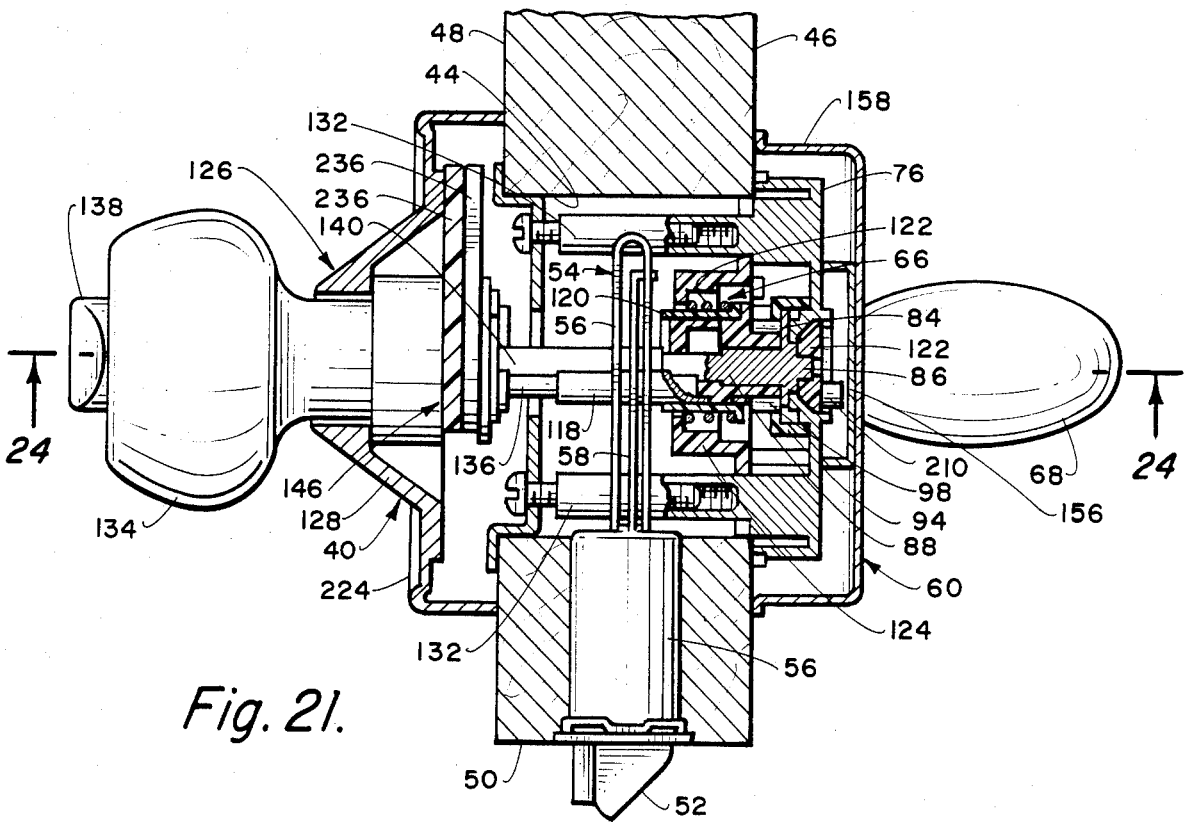
Fig. 21.
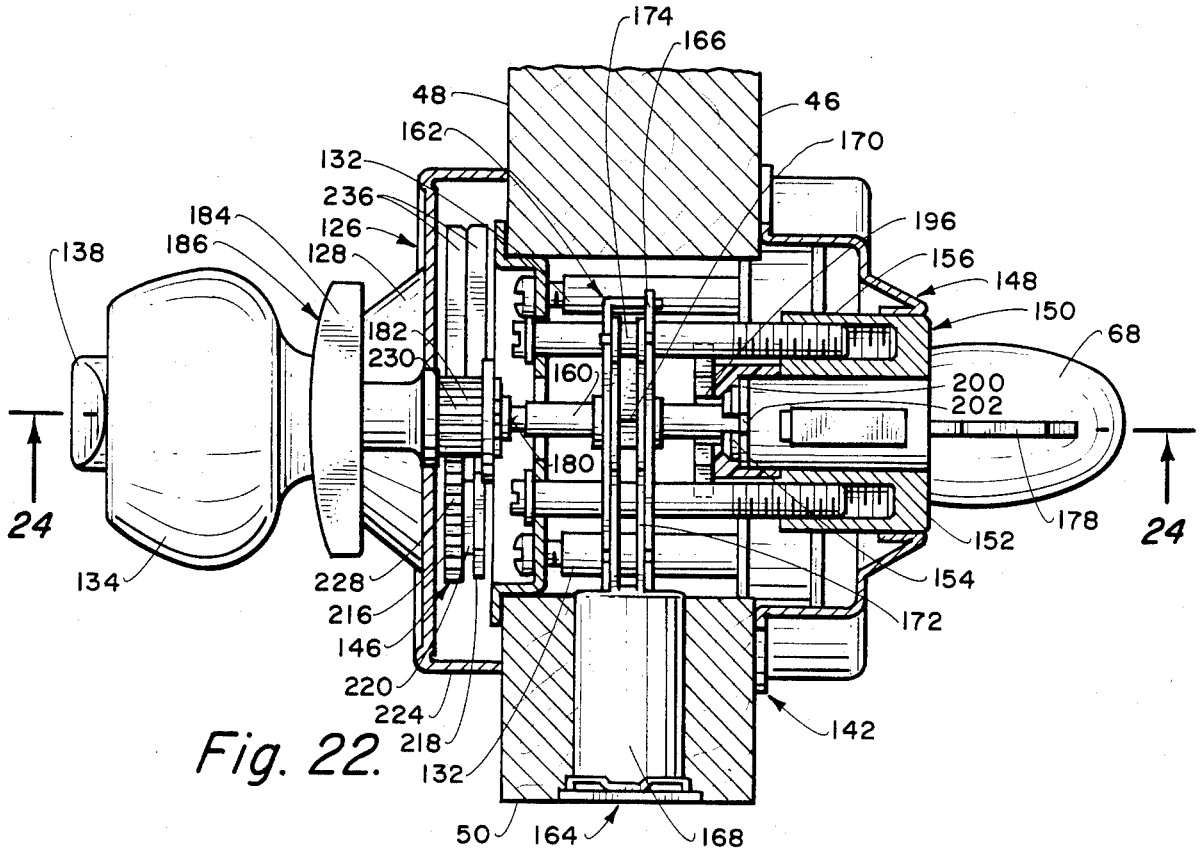

SINGLE AND DOUBLE LATCH OPERATING DEVICES WITH IMPROVED RACK-PINION OPERATION AND MOTION TRANSFER

BACKGROUND OF THE INVENTION

This invention relates to a unique latch construction and more particularly, to one which may be provided in a relatively wide variety of choices of different constructions, yet each may include certain features with each comprising patentable ingenuity. The latch construction may be of relatively simple form having a single latchbolt with an interior operator and an exterior operator, the latter comprising a unique form of rack and pinion. This rack and pinion as an exterior operator may also have added thereto a lock for shifting the rack and pinion to also place it in either of its operable or non-operable positions. Still an addition and of more complexity, a second latch construction may be added to the first latch construction with it having merely a single exterior operator or a single interior operator or both. The two latch constructions may be operably connected by a motion transferring yoke which merely just unlocks the first latch construction by means of unlocking the second latch construction, or the latchbolts may be connected by a panic assembly which withdraws the second latchbolt when the first inside operator is actuated to withdraw the first latchbolt, or both of these motion transferring yoke and panic assemblies may be added. Thus, it is seen that a wide variety of beneficial features may be added to the construction, all according to the principles of the present invention.

Various forms of rack and pinion constructions have been used for providing the withdrawal motion in latchbolt structures. In most cases, the purpose of the rack and pinion arrangements is merely to withdraw the bolt once the bolt has been freed of any locking mechanism, in other words, the bolt is locked independently of any movement action by the rack and pinion arrangement. There have been some of the rack and pinion constructions which have included locking means directly therein but, to our knowledge, these have been locking arrangements which directly block the rack and pinion movement as opposed to blocking the bolt movement.

In the lockable rack and pinion constructions, there has never been also connected thereto the various of the different other latchbolt features and the structure required for such connections. For instance, there have never been, to our knowledge, a single latchbolt construction having an exterior lock and an interior operator, both of which control the shifting of the rack and pinion between engaged and disengaged positions. There has never been, to our knowledge, a double latchbolt construction which has cooperable elements therein providing the shifting of the first latchbolt rack and pinion between its engaged and disengaged positions by elements in the second latchbolt construction. There has never been, to our knowledge, a double latchbolt construction having a panic assembly therein which bypasses the rack and pinion construction provided for the first latchbolt and actuates both of the latchbolts simultaneously from the interior side to swiftly release the particular door being retained.

OBJECTS AND SUMMARY OF THE INVENTION

It is, therefore, an ojbect of this invention to provide a latch operating device which is of a single or double latchbolt form and has one of the latchbolt constructions with an exterior or outside operator including a rack and pinion, and which rack is shiftable between an engaged and disengaged position relative to the pinion, thereby making the rack and pinion of the latch operating device operable or inoperable as desired. In a preferred embodiment thereof, the pinion rotatably drives the latch driving mechanism to move the bolt between extended and retracted positions and the rack is connected to the pinion either engaged with the pinion for transferring motion from a thumbpiece or slidable to be spaced from the pinion and free of transferring motion from the rack to the pinion. The movements of the rack between engaged and disengaged positions relative to the pinion are determined by a cam and spindle with the spindle extending into the interior operator and movable therefrom to move the rack between its positions. Thus, in this simplest form, the rack and pinion arrangement is either locked during which the rack is spaced from the pinion and there is no rack-pinion motion transferred to the bolt, or the rack is slid to operable connection with the pinion for transferring the rack-pinion motion in an unlocked condition to the bolt for moving the same.

It is a further object of this invention to provide a latch operating device which is of the foregoing simple form thereof and has added thereto a lock construction in the exterior operator thereof for also moving the rack at least from its non-engaged position to its pinion engaged position, all in addition to the operating control provided by the interior operator. In the preferred embodiment, in addition to the shiftable rack and pinion construction, the interior operator with its spindle and cam controlling rack-pinion positioning and the thumbpiece engagement with the rack for supplying motion thereto, a lock is positioned in the exterior operator and is connected through preferably a crossbar to the same cam used for the interior operator control. Therefore, either the interior operator through the spindle and cam may be used or the exterior operator lock through the crossbar and the same can may be used for controlling the positioning of the rack relative to the pinion, the rack being moved either to its pinion engaged or disengaged positions.

It is an additional object of this invention to provide latch operating devices of the foregoing general character, but modified to have both a first latchbolt construction with its rack and pinion control and a second latchbolt construction spaced therefrom and operably connected to the first latchbolt construction for, in addition to its normal latchbolt functioning, providing certain motions to the first latchbolt construction as determined by the particular form. In a preferred embodiment, the first latchbolt construction includes the first latchbolt driven by a latch driving mechanism which is controlled for movement by the rack and pinion in the exterior operator having the motion supplying thumbpiece, and the cam and spindle connection into the interior operator for controlling the position of the rack and pinion. The second latchbolt construction will have the bolt driven by the second latch driving mechanism and this second mechanism is provided motion by either an exterior operator lock or an interior operator turnpiece or both. The first and second latchbolt constructions are, in this case, operably connected by a yoke which is arranged so that unlocking of the lock in the exterior operator of the second latchbolt to move the bolt of the second latchbolt to disengaged position will transmit motion through the yoke to the rack of the first latchbolt and move the rack into engaged position relative to the pinion. Thus, the exterior operator thumbpiece can then be actuated to withdraw the bolt of the first latchbolt. At the same time, the motion of the first latchbolt will not have an effect of transmitting motion through the yoke to the second latchbolt, so that any exterior operator lock or interior operator turnpiece of the second latchbolt will remain independent of the first latchbolt.

It is also an object of this invention to provide a latch operating device which is of the foregoing double latchbolt form and which may include a unique panic assembly therein either with or without the yoke as hereinafter described. In a preferred embodiment simpler form, the first latchbolt will have the slidable rack and pinion controlled by the spindle and cam connected into the interior operator, and the rack motion provided by the exterior operator thumbpiece, while the second latchbolt may have the exterior operator lock and the interior operator turnpiece. A panic assembly is operable between the first and second latchbolts connected at the first latchbolt to the inside operator and connected at the second latchbolt to the latch driving mechanism of this second latchbolt. Further, the panic assembly is operable from the interior operator of the first latchbolt through to the latch driving mechanism of the second latchbolt for simultaneously withdrawing both bolts, yet not capable of transmitting similar motion in reverse direction from the second latchbolt to the first latchbolt.

In a more complex, preferred embodiment form, the previously discussed yoke connection is additionally provided between the first and second latchbolts. Thus, in usual operation when the exterior operator lock of the second latchbolt is unlocked withdrawing the bolt of the second latchbolt, this movement is transferred through the yoke to the rack of the first latchbolt placing the rack in driving engagement with the pinion and ready for movement by the exterior operator thumbpiece. In the reverse direction from the first to the second latchbolt, there is no motion transfer between the first and second latchbolts, each operating on its own movement. Still at the same time, however, the panic assembly still serves its same purpose, that of transferring motion from the interior operator of the first latchbolt to the latch driving mechanism of the second latchbolt for withdrawing the second latchbolt, the first being withdrawn simultaneously. Again, only in the reverse, no motion by the second latchbolt is transferred through the panic assembly to the first latchbolt so that each operates without any interferences from the other.

Other objects and advantages of the invention will be apparent from the following specification and the accompanying drawings which are for the purpose of illustration only.

BRIEF DESCRIPTION OF THE DRAWINGS

FIG. 21 is an enlarged, horizontal sectional view looking in the direction of the arrows 21—21 in FIG. 17;

FIG. 22 is an enlarged, horizontal sectional view looking in the direction of the arrows 22—22 in FIG. 17;

DESCRIPTION OF THE BEST EMBODIMENTS CONTEMPLATED

The single and double latch operating devices of the present invention are separately described herein along with the various combinations of use. Furthermore, the various elements used and described herein are of usual mechanical form well known to those skilled in the art and may be fabricated from usual materials except as otherwise pointed out. It should be kept in mind, however, that the particular embodiments illustrated herein are solely for purposes of illustration and that it is not intended to limit the principles of the present invention to the particlar embodiments shown.

Figure 5:
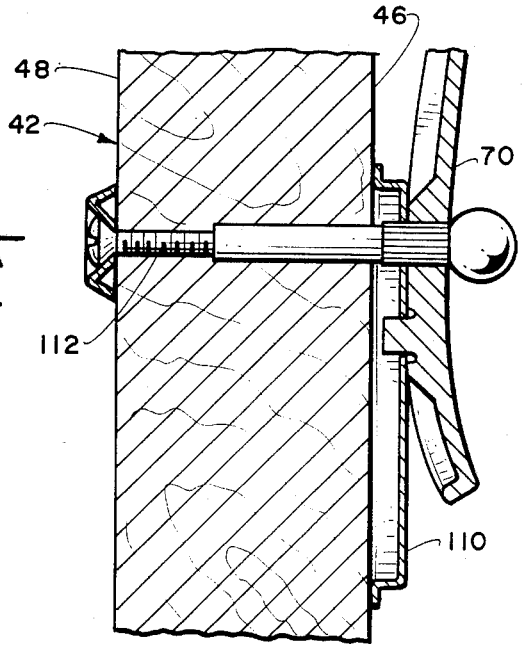
FIG. 5 is a vertical sectional view looking in the direction of arrows 5—5 in FIG. 4.
Figure 6:
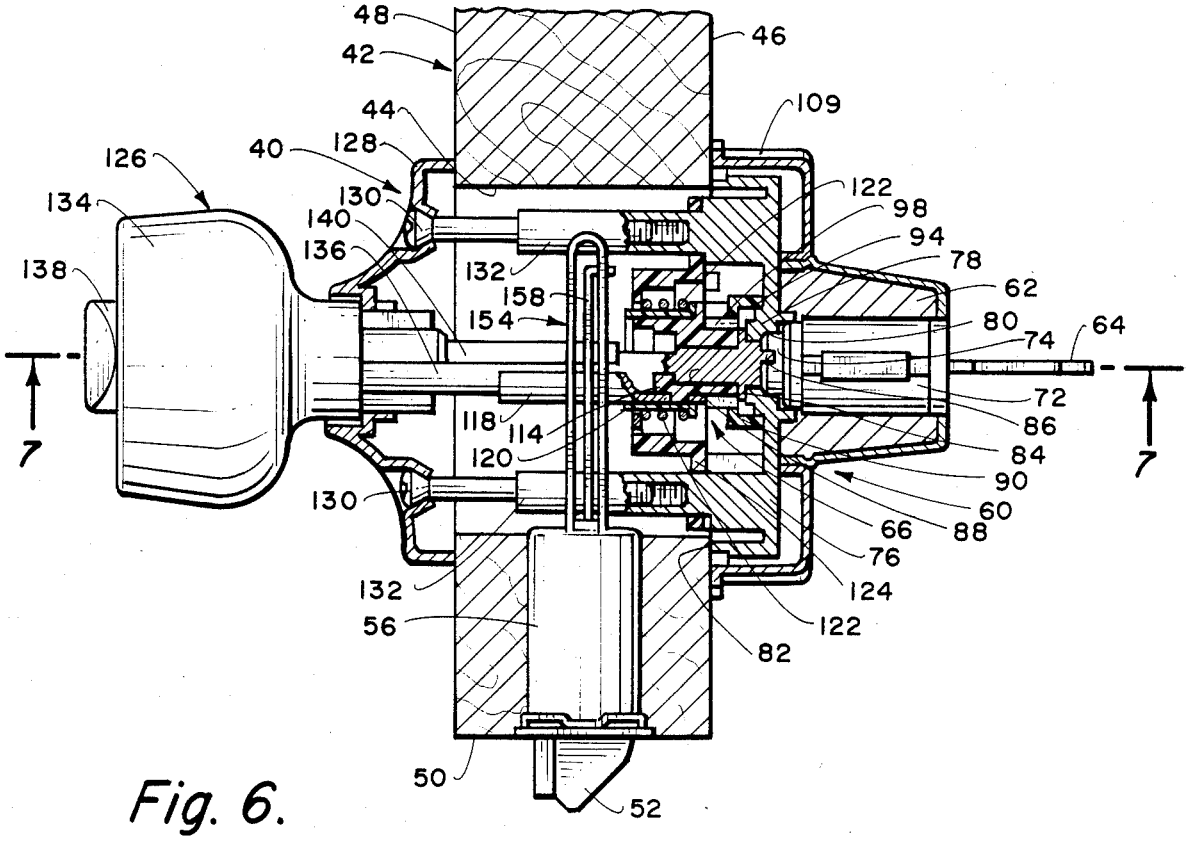
FIG. 6 is an enlarged, horizontal sectional view looking in the direction of the arrows 6—6 in FIG. 1.

Referring to the single latch operating device as illustrated in FIGS. 1 through 16, the latch operating device includes a latchbolt construction generally indicated at 40 mounted in a door generally indicated at 42 extending transversely through a door opening 44 between an exterior side 46 and an interior side 48. The latchbolt construction 40 also extends longitudinally within the door to the door edge 50 and projects a latchbolt 52, in this case, a biased latchbolt which is permanently spring pressed outwardly projecting from the door edge and may be withdrawn generally to the door edge between an extended and retracted position. A latch driving mechanism generally indicated at 54 is formed by a latch frame 56 as seen in FIG. 6 and houses the foregoing biased latchbolt 52, it being controlled for movement by a latchbolt extension 58 extending within the latch frame 56 rearwardly within the door opening 44.

Referring for the moment to FIGS. 6 through 9 and 16, the latchbolt construction 40 further includes an exterior operator generally indicated at 60 formed by a usual pin-type lock 62 with a key 64, a rack-pinion construction generally indicated at 66, a thumbpiece 68 for operating the rack-pinion construction and a somewhat usual form of door handle 70 for controlling the door movement. The lock 62 is of usual construction having a lock cylinder 72 housing a lock plug 74 with the key 64 usuable for turning the lock plug for operating the same. In this instance, the lock 62 terminates spaced outwardly slightly from the door exterior side 46, slightly telescoped in an exterior insert 76, as clearly seen in FIGS. 6 through 8 and 16. The lock 62 terminates inwardly in a grooved receptacle 78 received in a center opening 80 of the exterior insert 76, all of which will be hereinafter discussed more in detail.

Figure 12:
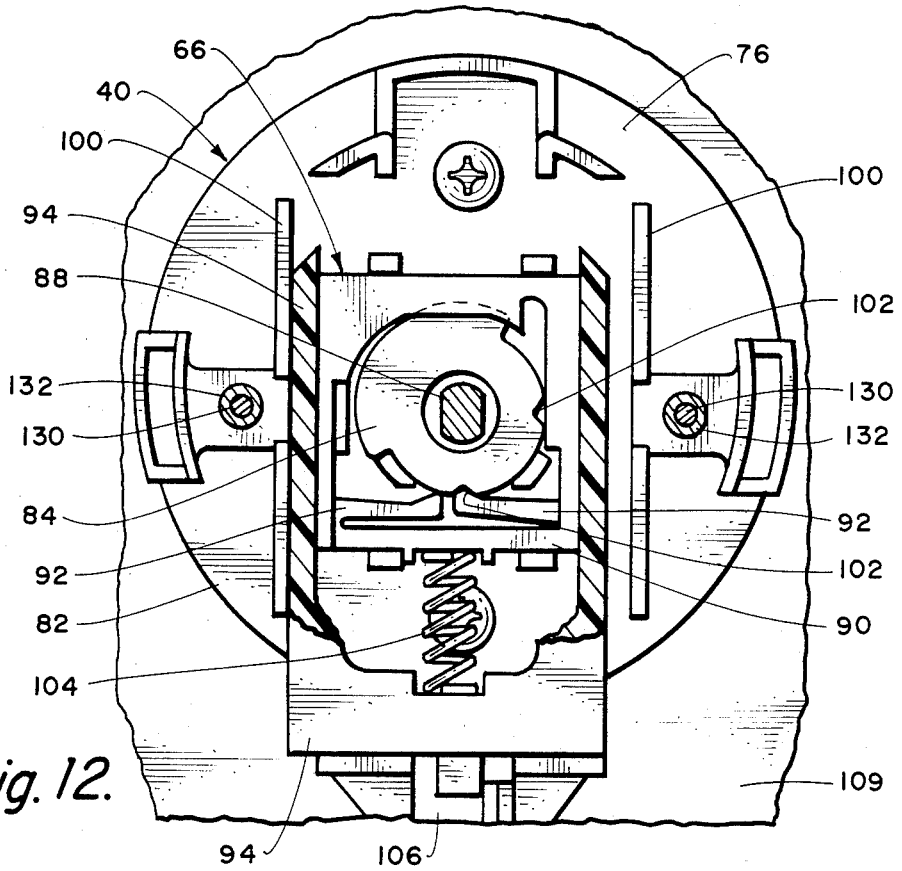
FIG. 12 is an enlarged, vertical sectional view looking in the direction of the arrows 12—12 in FIG. 7, the rack-pinion being shown engaged and ready for latchbolt movement.
Figure 14:
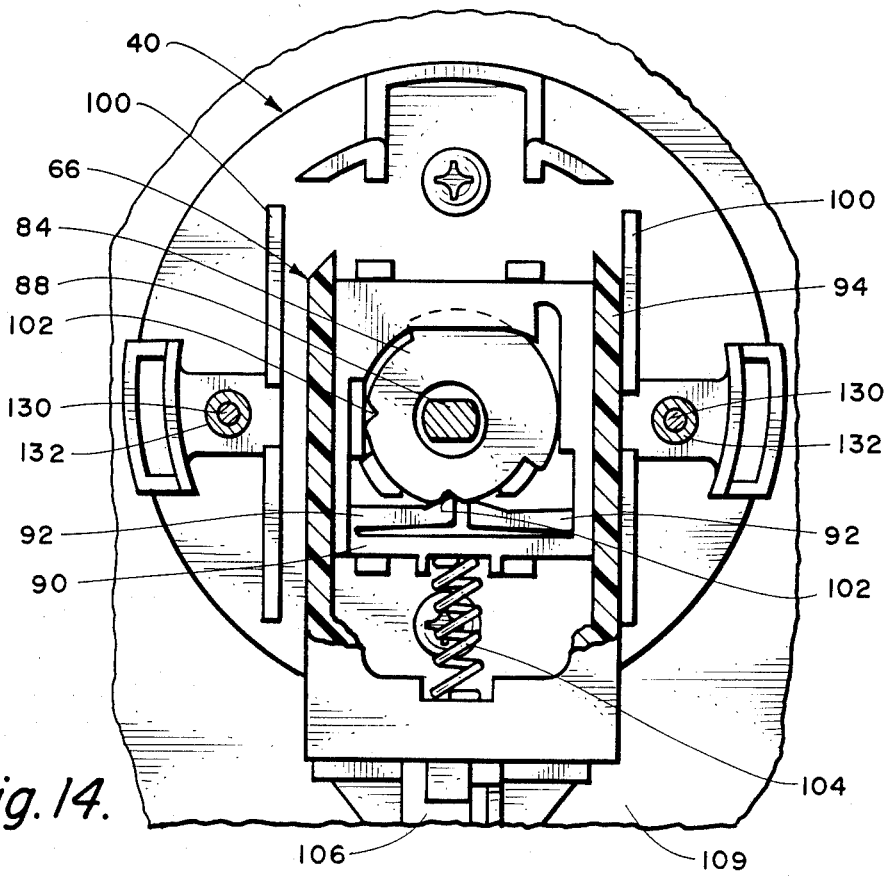
FIG. 14 is a view similar to FIG. 12, but with the rack-pinion in disengaged condition.
Figure 15:
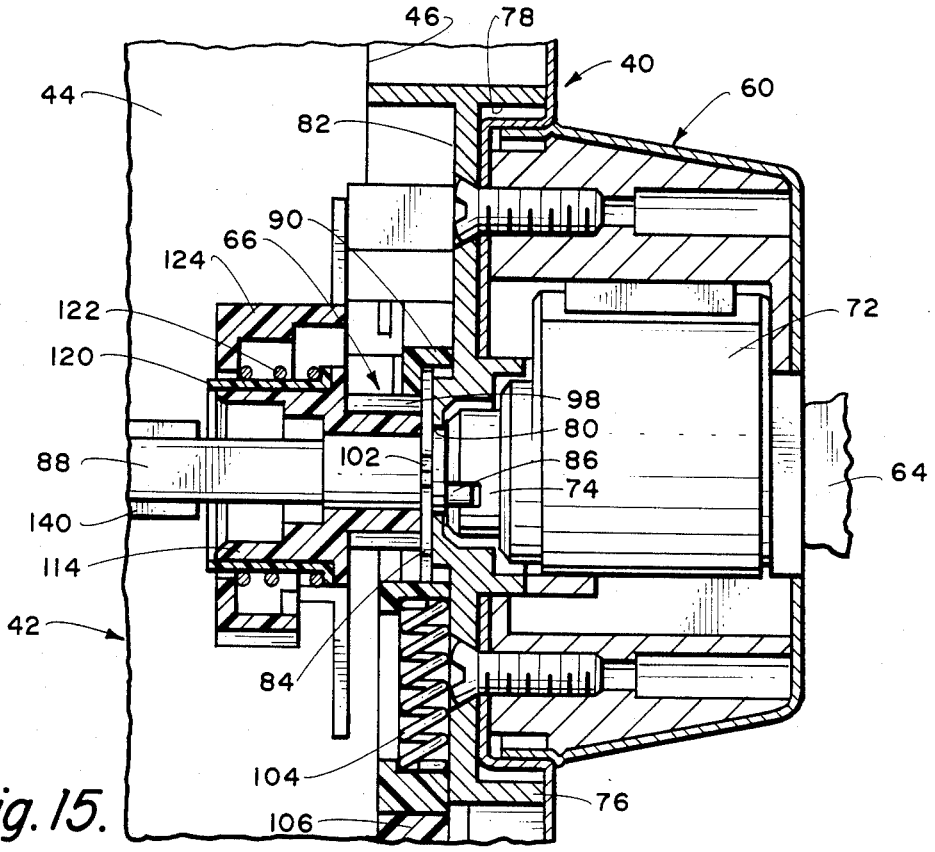
FIG. 15 is a vertical sectional view looking in the direction of the arrows 15—15 in FIG. 10.
Figure 16:
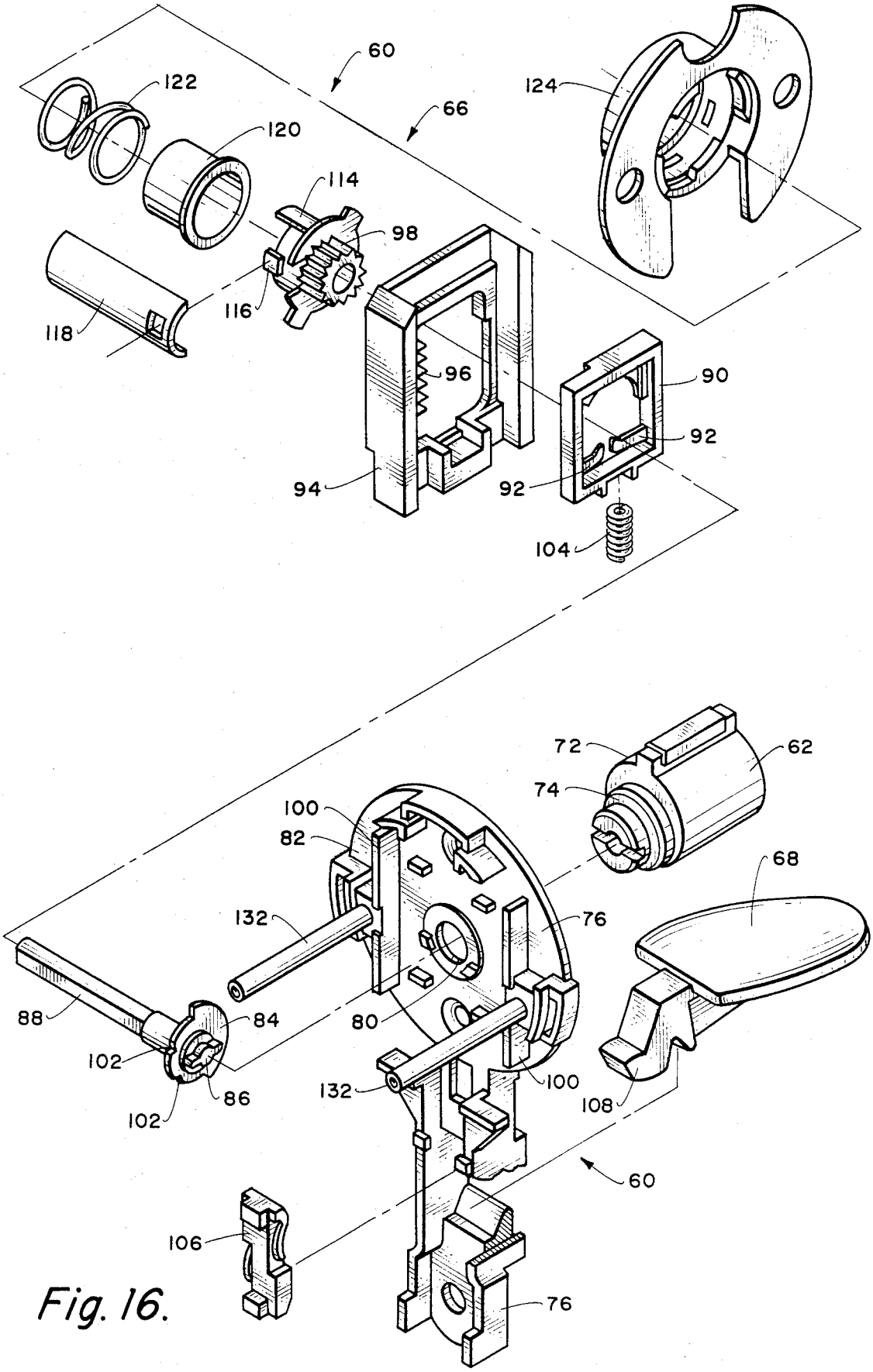
FIG. 16 is an exploded view showing the various working elements of the single latchbolt construction of FIGS. 1 through 15.

The rack-pinion construction 66 is mounted against an inner side 82 of the exterior insert 76 and includes, in order, from the exterior insert 76, a rack cam 84 having a cross bar 86 secured to the outer face thereof and the cross bar received in the grooved receptacle 78 previously pointed out within the exterior insert center opening 80. This rack cam 84 is mounted for limited rotation and can be seen in FIGS. 12 and 14, FIG. 12 showing one rotative position and FIG. 14 the other rotative position, both to be hereinafter explained. Furthermore, the rack cam 84 is secured to a cam spindle 88 which projects nearly through the door opening 44, as shown in FIG. 7.

Outwardly surrounding the rack cam 84 is a cam housing 90 having cam control members 92 formed therein and, as particularly shown in FIGS. 12 and 14, serving to define the cam limited rotation and cam control as will be explained below. Transversely outwardly abutting the cam housing 90 is a rack 94 having rack teeth 96 along the one side thereof as shown in FIGS. 10, 11, 13 and 16. Inwardly within the rack 94 and transversely aligned with the rack teeth 96 is a pinion 98 which is received over the cam spindle 88 rotatable relative thereto. Transversely outwardly of the rack 94 are rack stop bars 100 secured to the exterior insert 76 and limiting transverse slidable movement of the cam housing 90 and the rack 94, but permitting limited vertical movement thereon.

Figure 11:
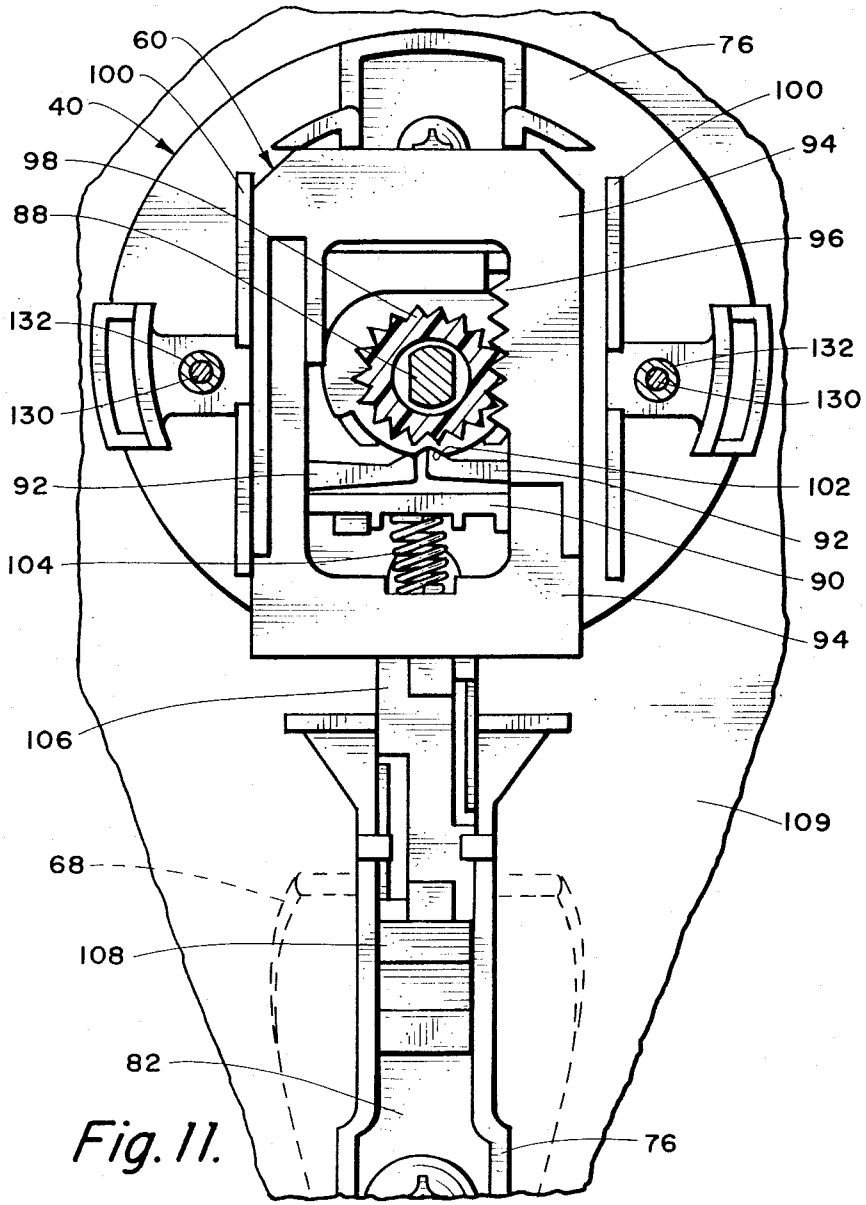
FIG. 11 is a view similar to FIG. 10, but with the rack-pinion being in latchbolt withdrawing condition, the thumbpiece of the rack-pinion being shown pressed down in phantom lines.
Figure 10:
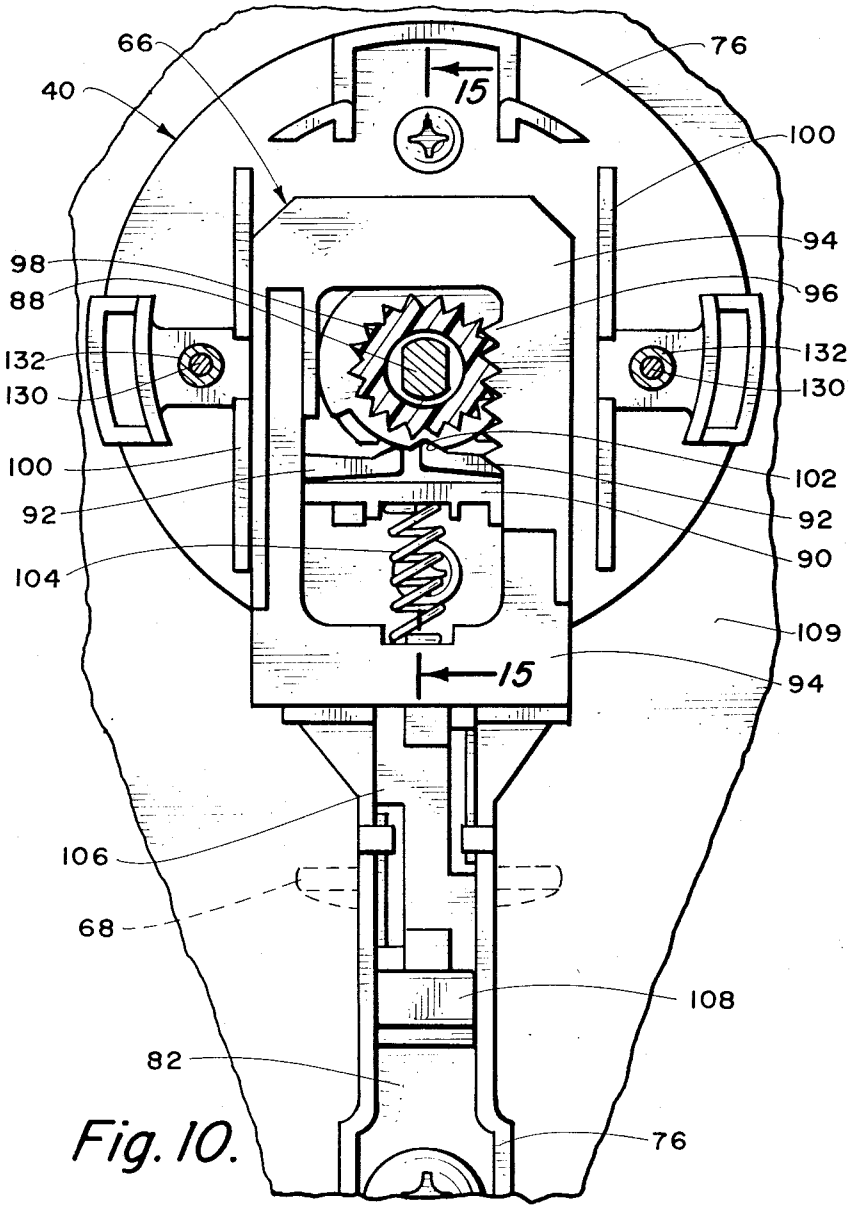
FIG. 10 is an enlarged, vertical sectional view looking in the direction of the arrows 10—10 in FIG. 7, the rack-pinion being shown in engaged condition, but still in non-latchbolt withdrawing condition.
Figure 13:
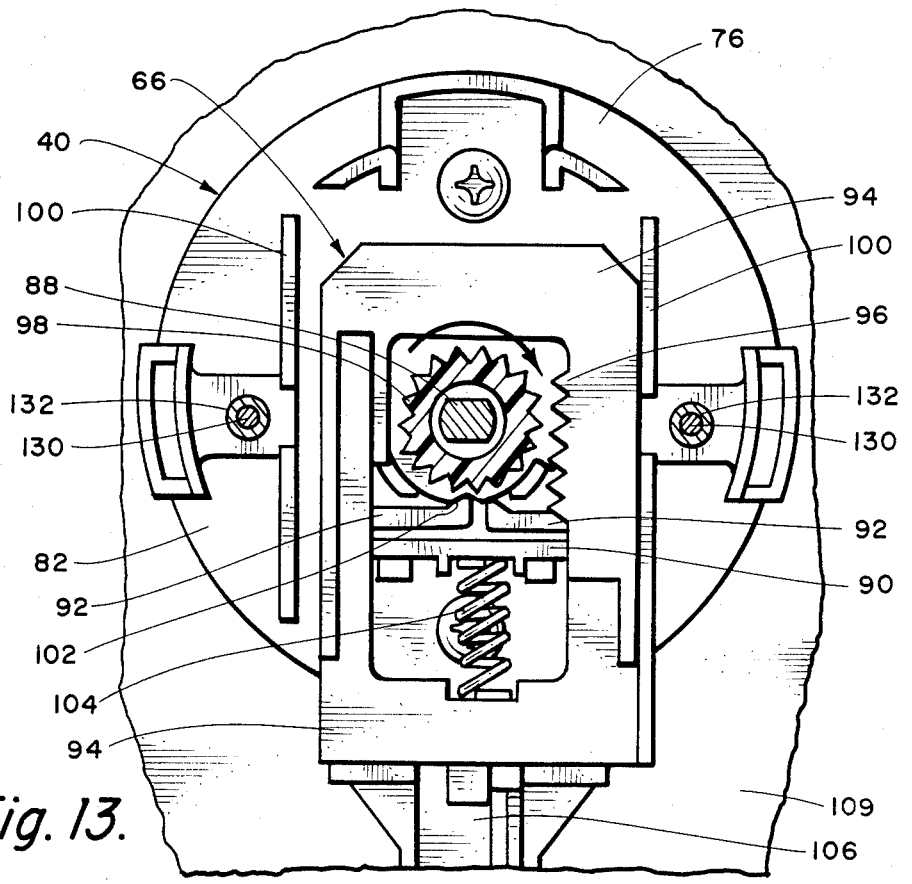
FIG. 13 is a view similar to FIG. 10, but with the rack-pinion shown in disengaged condition.

Thus, when the rack 94 is shifted to the left by the rack cam 84 as shown in FIGS. 10 through 12, the rack teeth 96 are engaged with the mating teeth of pinion 98 and the pinion is moved by vertical movement of the rack relative thereto. The right hand cam control member 92 is engaged with a recess 102 of the rack cam 84,as shown in FIG. 12. However, when the rack cam 84 is rotated, in this case, clockwise, the left hand cam control member 92 engages in the other of the recesses 102, as seen in FIG. 14, to remove the rack teeth 96 from the teeth of the pinion 98 by moving the rack 94 to the right as shown in FIG. 13.

Figure 7:
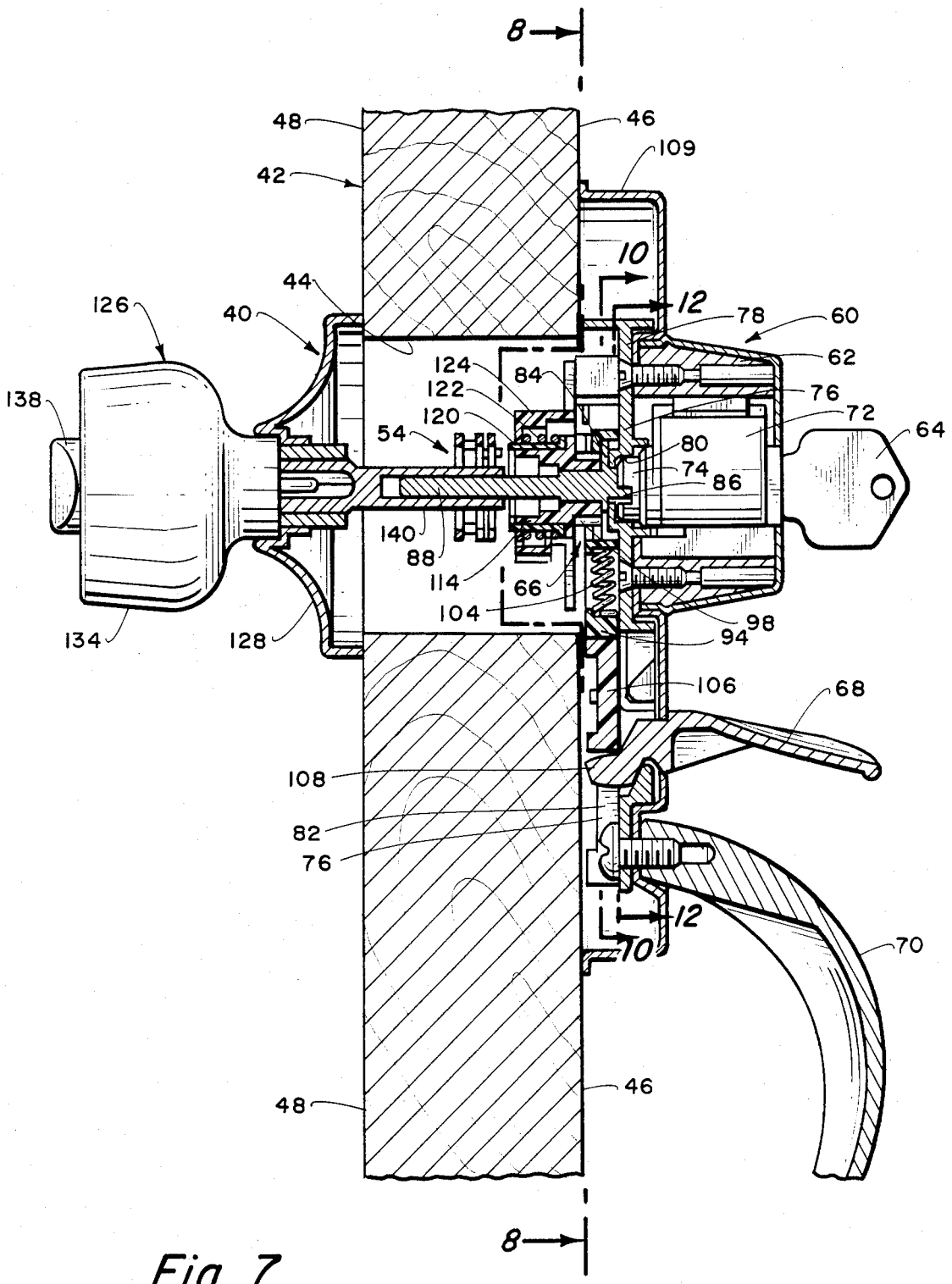
FIG. 7 is a vertical sectional view looking in the direction of the arrows 7—7 in FIG. 6.
Figure 8:
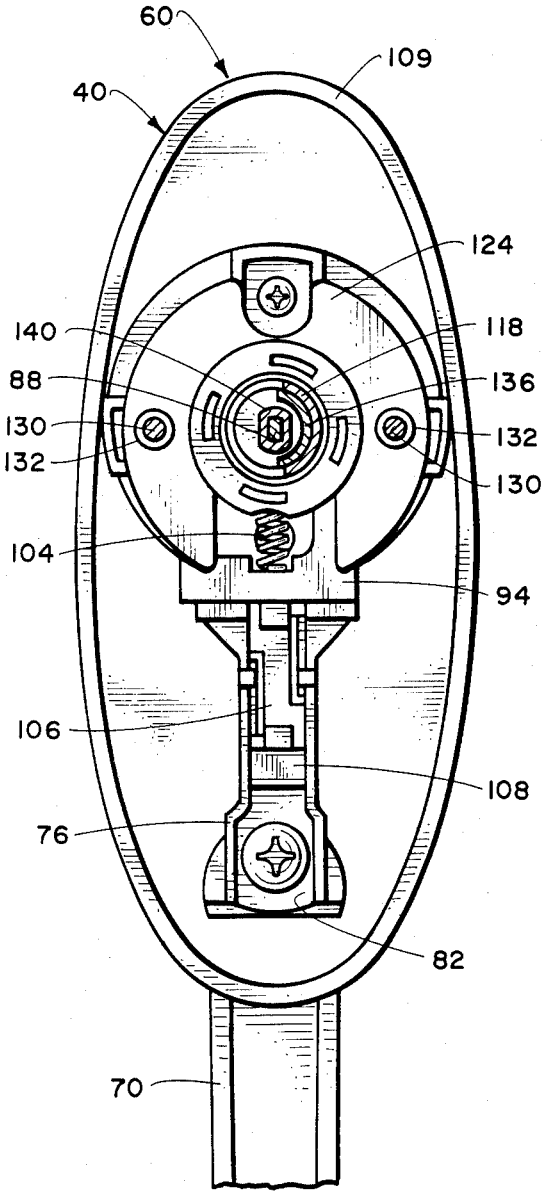
FIG. 8 is a vertical sectional view looking in the direction of the arrows 8—8 in FIG. 7.
Figure 9:
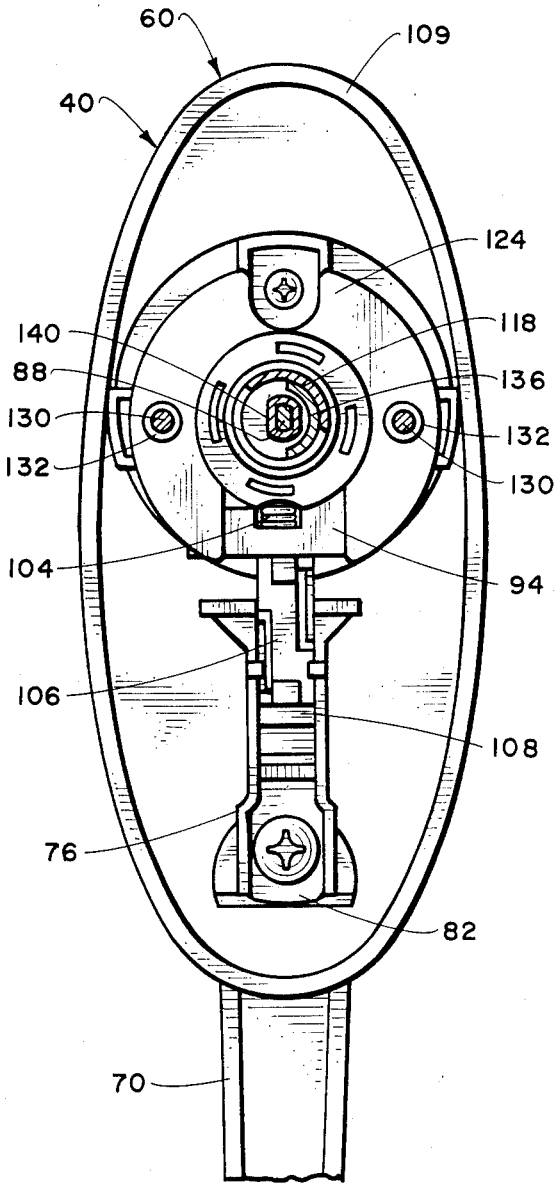
FIG. 9 is a view similar to FIG. 8, but with the rack-pinion of the exterior operator moved to latchbolt withdrawing condition from non-latchbolt withdrawing condition of FIG. 8 and with the rack-pinion in engaged condition.

As shown in FIGS. 7 through 9, for example, the vertical movement of the rack 94 is supplied by a compression spring 104 within the external operator 60, the spring bearing between the lower end of the cam housing 90 downwardly to the lower end of the rack 94.

Below the rack 94 and in vertical abutment therewith is a vertically slidable rack extension 106 which bears downwardly against a rockable end 108 of the thumbpiece 68. The thumbpiece 68 has its rockable end 108 engaged over the exterior insert 76 with the thumbpiece projecting through the exterior insert outwardly therefrom. Finally, the entire exterior operator 60 is outwardly finished by a cover plate 109.

Figure 4:
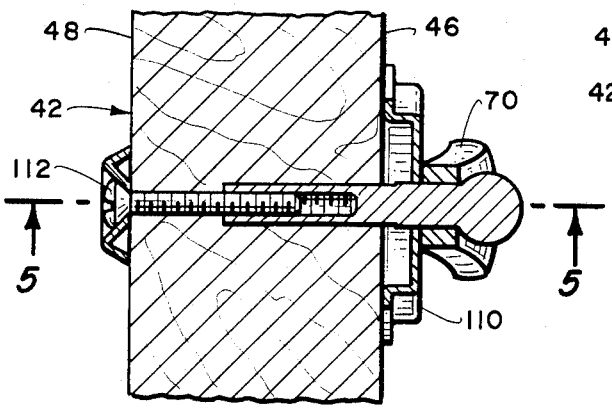
FIG. 4 is an enlarged, horizontal sectional view looking in the direction of the arrows 4—4 in FIG. 1.

Thus, as particularly seen in full lines in FIG. 7 and in phantom lines in FIGS. 10 and 11, the thumbpiece 68 is in upper released position as shown in FIGS. 7 and 10, and is pivoted downwardly in FIG. 11 to move the end thereof pivoted upwardly, in turn, raising both of rack extension 106 an the rack 94 upwardly. If the rack 94 is engaged with the pinion 98 as in FIG. 11, the pinion 98 will be rotated, the consequences of which to be hereinafter discussed, but if the rack is spaced from the pinion, for instance, as shown in FIG. 13, there will be no motion transfer between the rack and pinion. To provide for convenience in operating the thumbpiece 68, a door handle 70 is provided, it being secured at its upper end to the lower end of the exterior insert 76, as shown in FIG. 7, and projects downwardly along the door exterior side 46 to be secured spaced downwardly from the remainder of the latchbolt construction 40. As shown in FIGS. 4 and 5, the lower end of the door handle 70 is secured by a lower bracket 110 and a bolt 112 projecting through the door and secured to the interior side 48.

As seen in FIGS. 6 through 9, 15 and 16, the pinion 98 at its inner side has a pinion frame 114 and an engagement member and recess 116 for receiving an end of an exterior half-round spindle 118 thereon and extending within the door opening 44 to nearly the opposite side of the door 42. An eyelet 120 is received over the spindle 118 against the pinion frame 114. A retaining spring 122 is received over the eyelet 120 and an index plate 124 is also received over the eyelet spaced outwardly thereof, with the index plate being secured to the inner side 82 of the exterior insert 76. The inner end of the exterior half-round spindle 118 passes through the latchbolt extension 58 of the latch driving mechanism 54 and is engaged therewith in usual manner for moving the latchbolt 52 from its "at rest" extended position, as shown in FIGS. 6 and 8, to its retracted position, as shown in FIG. 9.

The interior operator generally indicated at 126 is mounted at the interior side 48 of the door 42 by an interior frame 128 which is secured to this door interior side by a pair of usual fasteners 130 which engage receptacles 132 extending inwardly from the exterior insert 76 and through the latch frame 56 to the fasteners. An interior knob 134 is rotatably mounted on the frame 128 and has an interior half-round spindle 136 secured thereto. The interior half-round spindle 136 projects inwardly within the inner end of the exterior half-round spindle 118 slidable relative thereto. Thus, movement of the interior knob 134 in either direction from a neutral position will move the latchbolt 52 from its outer "at rest" extended position inwardly to its retracted position.

Generally centrally of the interior knob 134, there is rotatably mounted a control turn button 138 which is rotatable relative to the interior knob and is inwardly secured to the outer end of a cam spindle extension 140. The inner end of the cam spindle extension 140 is received telescoping the inner end of the cam spindle 88 so that all rotative motion of the control turn button 138 will be transmitted through the cam spindle extension 140, the cam spindle 88 and, ultimately, into rack cam 84. Thus, by use of the control turn button 138 on the interior knob 134, the rack-pinion construction can be placed as desired in engaged position where movement of the thumbpiece 68 in the exterior operator 60 may move the rack-pinion construction to withdraw the latchbolt 52. At the same time, the control turn button 138 may be placed in position in which the rack-pinion construction is disengaged so that operation of the rack-pinion construction will not withdraw the latchbolt. However, this still may be done by actuating either the lock 62 at the exterior operator 60 or the interior knob 134 at the interior operator.

Figure 1:
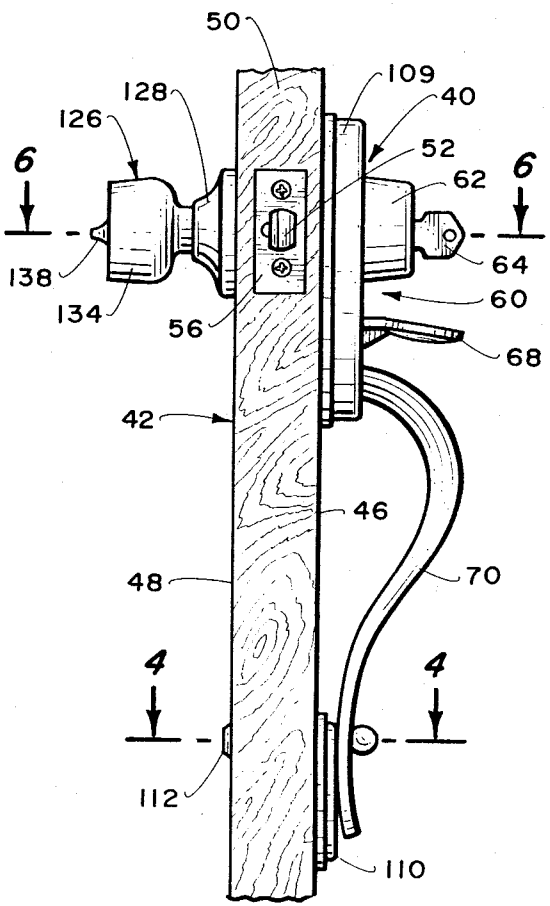
FIG. 1 is a fragmentary, front elevational view of a first embodiment of the latch operating devices of the present invention installed in a typical door, this being a single latchbolt construction and being shown with both sides in unlocked condition.

Briefly, in use of the first embodiment latchbolt construction 40 as shown in FIG. 1, the latchbolt construction in FIG. 1 is completely unlockled at both the exterior and interior sides. The control turn button 138 at the interior knob 134 is positioned so that the rack 94 of the exterior operator 60 is engaged with the pinion 98 in the manner shown in FIGS. 10 and 12. Thus, the thumbpiece 68 of the exterior operator 60 may be depressed and will turn the pinion 98 to turn the exterior half-round spindle 118 and withdraw the latchbolt 52. With this same unlocked positioning, the interior knob 134 of the interior operator 126 may also be turned to withdraw the latchbolt 52 by rotating the interior half-round spindle 136 of the interior operator 126, the lock 62 of the exterior operator 60 remaining unlocked throughout.

Figure 2:
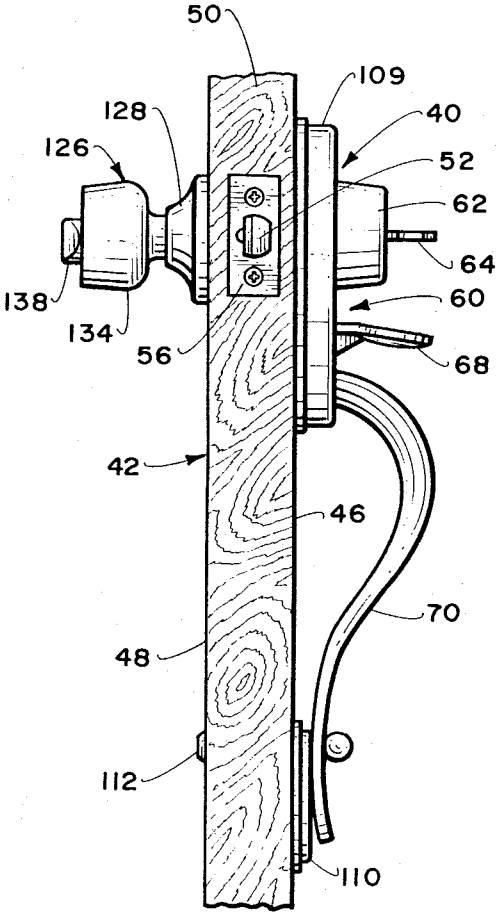
FIG. 2 is a view similar to FIG. 1, but with the key in the outside operator lock turned for placing the latchbolt construction in locked condition wherein all of the rack-pinion at the exterior operator, the latchbolt and the turn button at the interior operator are in locked condition.

In FIG. 2, either the key 64 of the lock 62 in the exterior operator 60 may be turned or the control turn button 138 in the interior knob 134 of the interior operator 126 may be turned to place the first embodiment latchbolt construction 40 in locked condition. As shown in FIGS. 13 and 14, the rack 94 of the exterior operator 60 is slid spaced away from the pinion 98 by turning of either of the key 64 in the lock 62 of the exterior operator 60 or the control turn button 138 in the interior knob 134 of the interior operator 126. This places the rack 94 free of engagement so that movement of the thumbpiece 68 is merely a free movement of rack and does not effect the positioning of the latchbolt 52. If this locked positioning is carried out by either of the lock 62 in the exterior operator 60 or the control turn button 138 at the interior operator 126, the other of these elements is automatically moved through the described structure to the locked condition.

Figure 3:
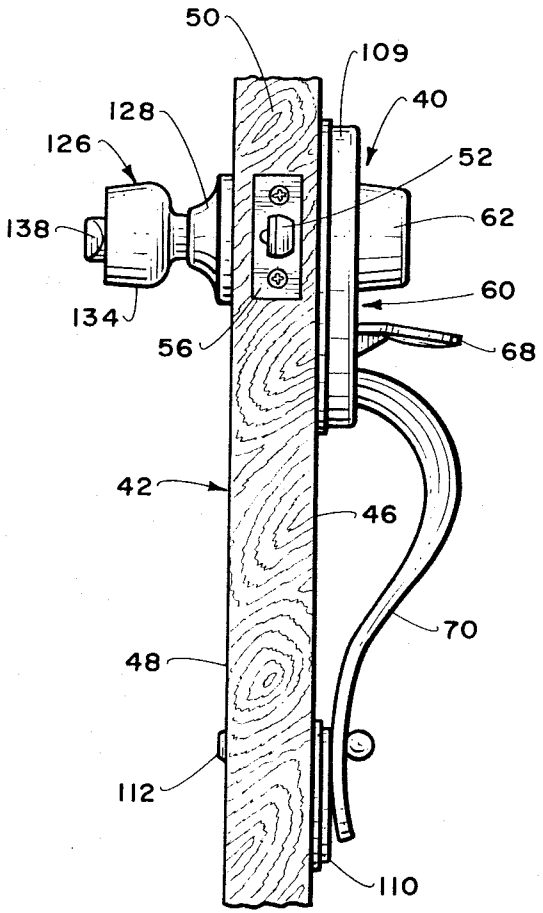
FIG. 3 is a view similar to FIG. 2, but with the key in the exterior operator lock removed, the rack-pinion in the exterior operator, the latchbolt and the turn button of the interior operator all remaining in locked condition, but it being possible to withdraw the latchbolt by turning of the interior operator.

Finally, in FIG. 3, the key 64 of the lock 62 in the exterior operator 60 has been turned back to neutral and removed. This places the exterior operator 60 completely locked and, as far as the exterior of the door is concerned, the exterior operator will remain locked until the key is reinserted. However, although the control turn button 138 of the interior operator 126 is now initally locked, the interior knob 134 may be rotated to withdraw the latchbolt 52 through rotation of the interior half-round spindle 136.

A second embodiment of latch operating devices of the present invention is shown primarily in FIGS. 17 through 32, but involves the single latchbolt construction 40 hereinbefore described as a first latch bolt construction 40 with certain deletions. The deletions involve the elimination of the lock 62 and the key 64 in the external operator 60. Furthermore, added thereto is a second latchbolt construction generally indicated at 142, a first and second latchbolt connecting yoke generally indicated at 144 and a first and second latchbolt connecting panic assembly generally indicated at 146.

The yoke 144 connects the first and second latchbolt constructions 40 and 142 in a particular manner and the panic assembly 146 connects them in a quite different manner all to be hereinafter discussed.

Briefly reviewing the first latchbolt construction 40 with the lock 62 and the key 64 eliminated, the first latchbolt construction includes a preferably biased latchbolt 52 which is connected through a latchbolt extension 58 to the latch driving mechanism 54 for movement from a normally extended position rearwardly to a retracted position. This movement of the latchbolt 52 is through a rack-pinion construction 66 either from exterior by a thumbpiece 68 in the exterior operator 60 or from interior by an interior knob 134 in the interior operator 126. The rack-pinion construction 66 includes the pinion 98 mounted for limited rotation and including an exterior half-round spindle 118 secured thereto with a movable rack 94. The rack 94 may move along the pinion when engaged therewith for moving the pinion or may move freely spaced from the pinion when not engaged therewith. In any case, the rack 94 is moved by the thumbpiece 68. Furthermore, the interior knob 134 in the interior operator 126 may also withdraw the latchbolt 52 through an interior half-round spindle 136 connected to the latch driving mechanism 54.

Finally, as far as the form of the first latchbolt construction 40 is concerned, the rack-pinion construction 66 is moved between its engaged and disengaged conditions by a rack cam 84 secured to a cam spindle 88. The rack cam 84 is within the cam housing 90 at the rack 94 and the cam spindle 88 projects inwardly to a cam spindle extension 140 which is engaged with a control turn button 138 centrally of the interior knob 134. Thus, rotation of the control turn button 138 changes the engaged or disengaged conditions of the rack cam 84 to alter the positioning of the rack 94 relative to the pinion 98. At the other side of the rack cam 84 from the cam spindle 88 is a crossbar 86, again secured to the rack cam and rotating therewith. This crossbar 86, in this second embodiment construction, serves an important function to be hereinafter discussed more in detail.

Figure 24:
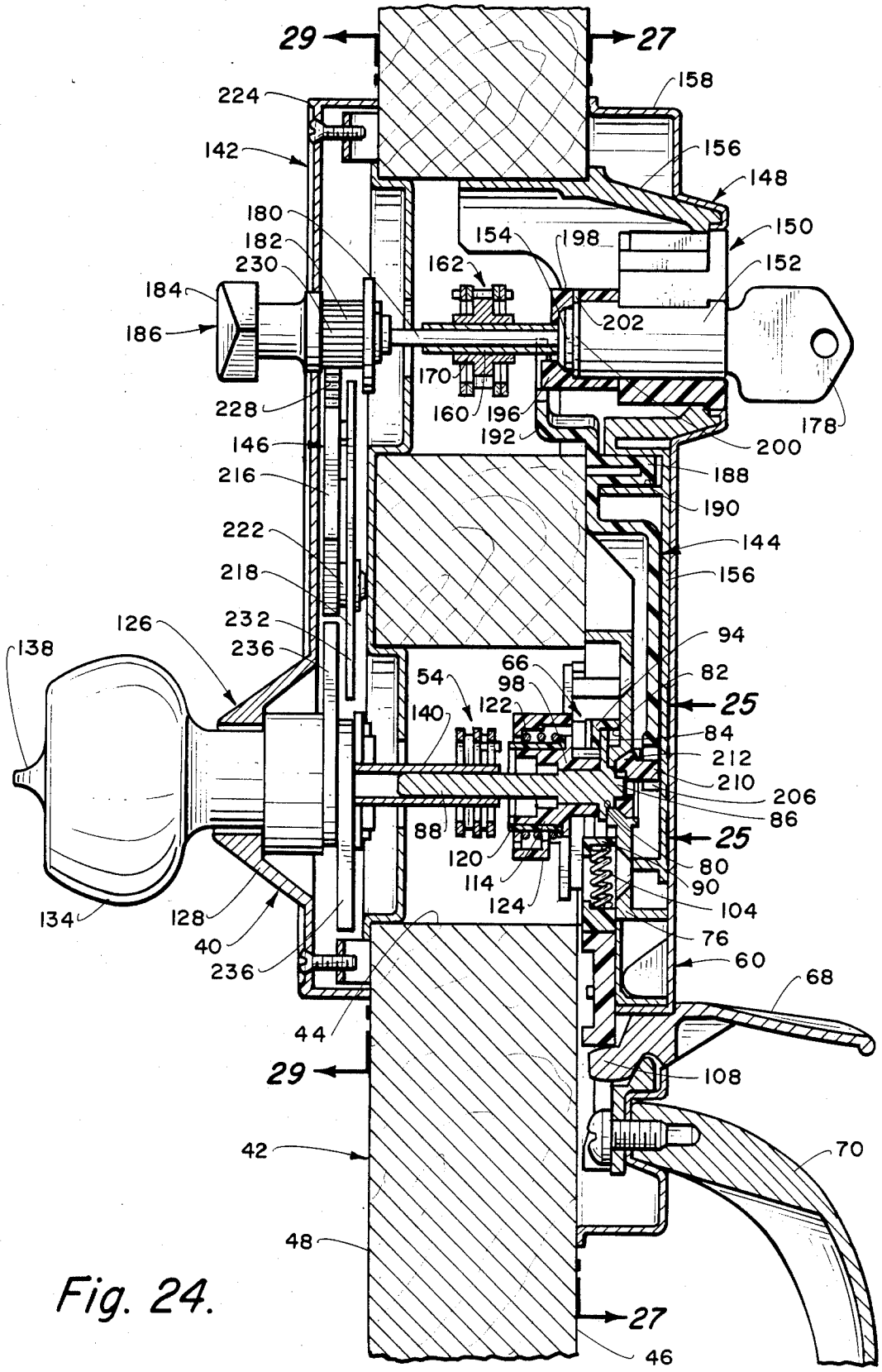
FIG. 24 is a vertical sectional view looking in the direction of the arrows 24—24 in both of FIGS. 21 and 22.

Referring to FIGS. 22 and 24, the second latchbolt construction 142 is spaced above the first latchbolt construction 40 and includes an exterior operator generally indicated at 148 in the form of a pin-type lock, preferably a deadbolt lock 150, having a lock cylinder 152 and a lock plug 154. The deadbolt lock 150 is of standard usual form, the key thereof movable to neutral position for removal, with one direction of rotation for locking and the other for unlocking at opposite sides of neutral. Further, the deadbolt lock 150 is mounted within a shield 156 which partially surrounds the lock cylinder 152 and projects downwardly to overlap a portion of the first latchbolt construction 40, as shown in FIG. 24. Still further, outwardly covering both the deadbolt lock 150 downwardly to and including all of the first latchbolt construction 40 to slightly below the start of the handle 70 is a cover plate 158, as also seen in FIG. 24.

Figure 23:
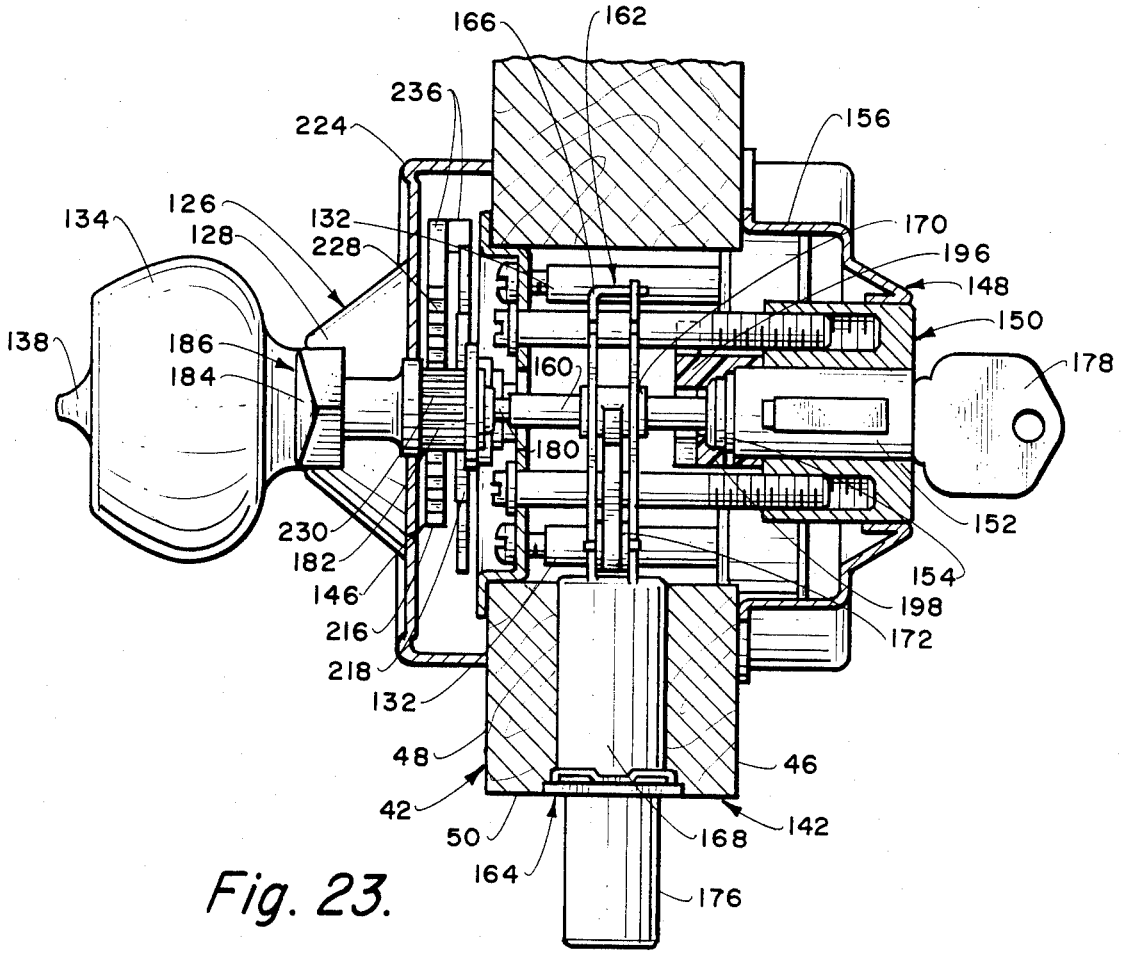
FIG. 23 is a view similar to FIG. 22, but with the latchbolt of the second latchbolt construction moved to extended condition.

The lock plug 154 of the deadbolt lock 150 projects inwardly and is secured to an exterior spindle 160 which extends axially of the second latchbolt construction 142 passing through and being engaged with a latch driving mechanism generally indicated at 162. As seen in FIGS. 22 and 23, the latch driving mechanism 162 is formed by a usual deadbolt assembly 164 having a frame extension 166 secured to a bolt housing 168 which opens at the door edge 50. The exterior spindle 160 engages a rotatable crank 170 which is pivotly connected to bolt extensions 172 by a crank arm 174. The bolt extensions 172 project into the bolt housing 168 and are connected to a deadbolt 176, as particularly seen in FIGS. 17 through 20 and 23.

Thus, the beadbolt assembly 164 may be moved between a retracted position shown in FIG. 22 and an extended position shown in FIG. 23. As shown in FIG. 22, the crank arm 174 is pivoted rearwardly withdrawing the bolt extensions 172 and thereby completely withdrawing the deadbolt 176 within the bolt housing 168. As shown in FIG. 23, the crank arm 174 is pivoted forwardly to extend the bolt extensions 172 and project the deadbolt 176 from the bolt housing 168. Different from the biased latchbolt 52 of the first latchbolt construction 40 which is spring urged to always return to extended position, this deadbolt 176 of this second latchbolt construction 142 remains in either of the extended or retracted positions until physically moved to the other of said positions.

As shown in FIGS. 22, 23 and 24, a key 178 partially rotates the lock plug 154 within the lock cylinder 152 to rotate the exterior spindle 160 and position the deadbolt 176 as hereinbefore described. Also, an interior spindle 180 is telescoped by the exterior spindle 160 and extends through a panic assembly pinion 182 into a turnpiece 184. The turnpiece 184 projects from the door interior side 48 and forms the interior operator 186. Thus, the deadbolt 176 may be positioned by a turnpiece 184, as well as the previously described deadbolt lock 150.

Now, referring to all of FIGS. 21 through 28 and 32, just inwardly of the exterior side 46 of the door 42, the yoke 144 extends downwardly between the exterior spindle 160 of the second latchbolt construction 142, hooks outwardly of the door exterior side, and then proceeds downwardly to just outwardly of the crossbar 86 on the outer side of the rack cam 84 in the first latchbolt construction 40. The yoke 144 is pivotally connected by a stub shaft 188 formed thereon intermediate the two latchbolt constructions 40 and 142 which is received in a shaft socket 190 on the shield 156, as best seen in FIGS. 24, 27, 28 and 32. The prime purpose of the yoke 144 and its pivotal or rocking motion between the first and second latchbolt constructions 40 and 142 is to transmit motion between the second latchbolt construction 142 and the first latchbolt construction 40, that is, in either direction.

Figure 32:
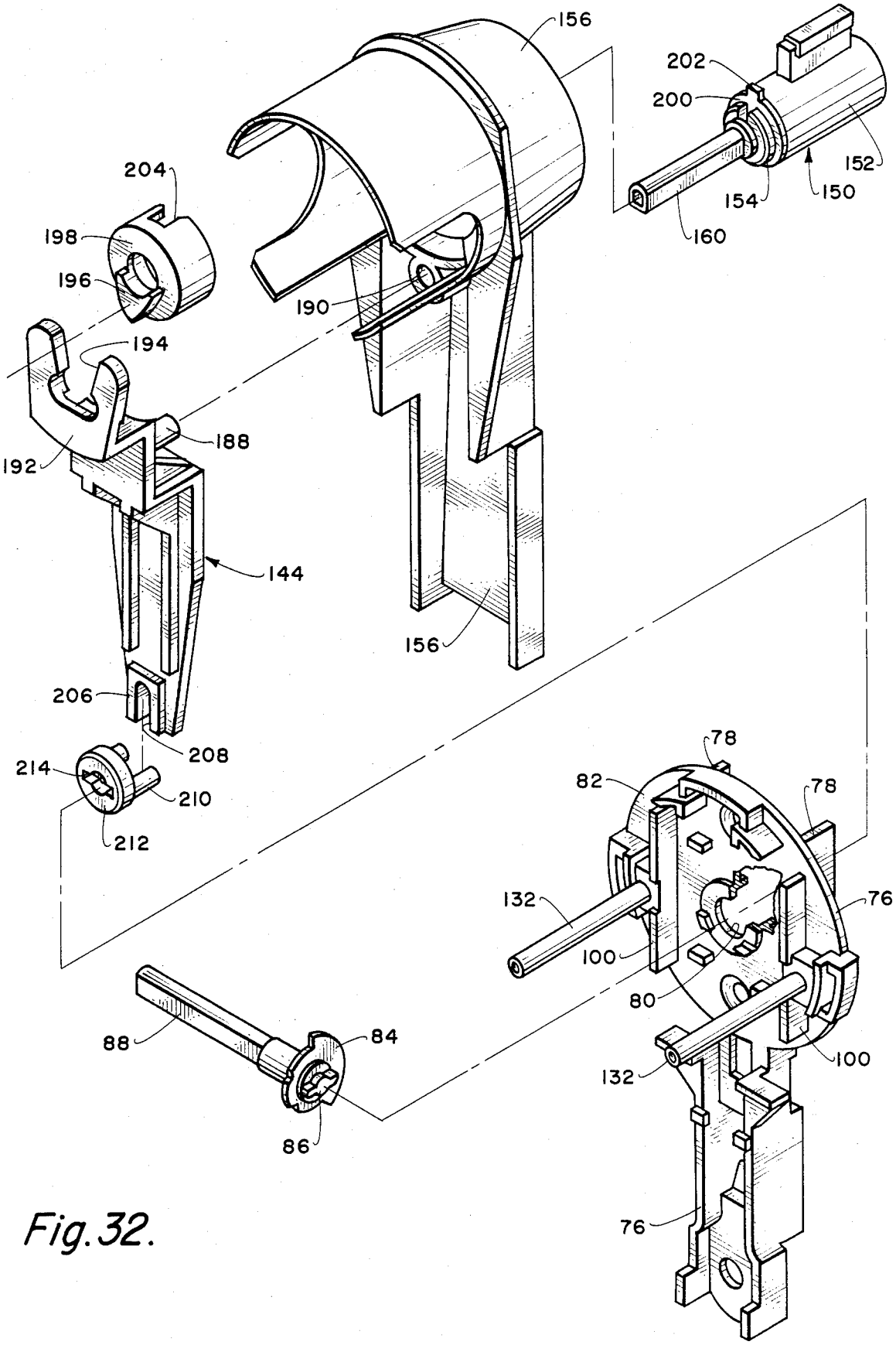
FIG. 32 is an exploded view of a portion of the first latchbolt construction and a portion of the second latchbolt construction with the yoke therebetween to illustrate the operable connection of the yoke between the first and second latchbolt constructions.
Figure 27:
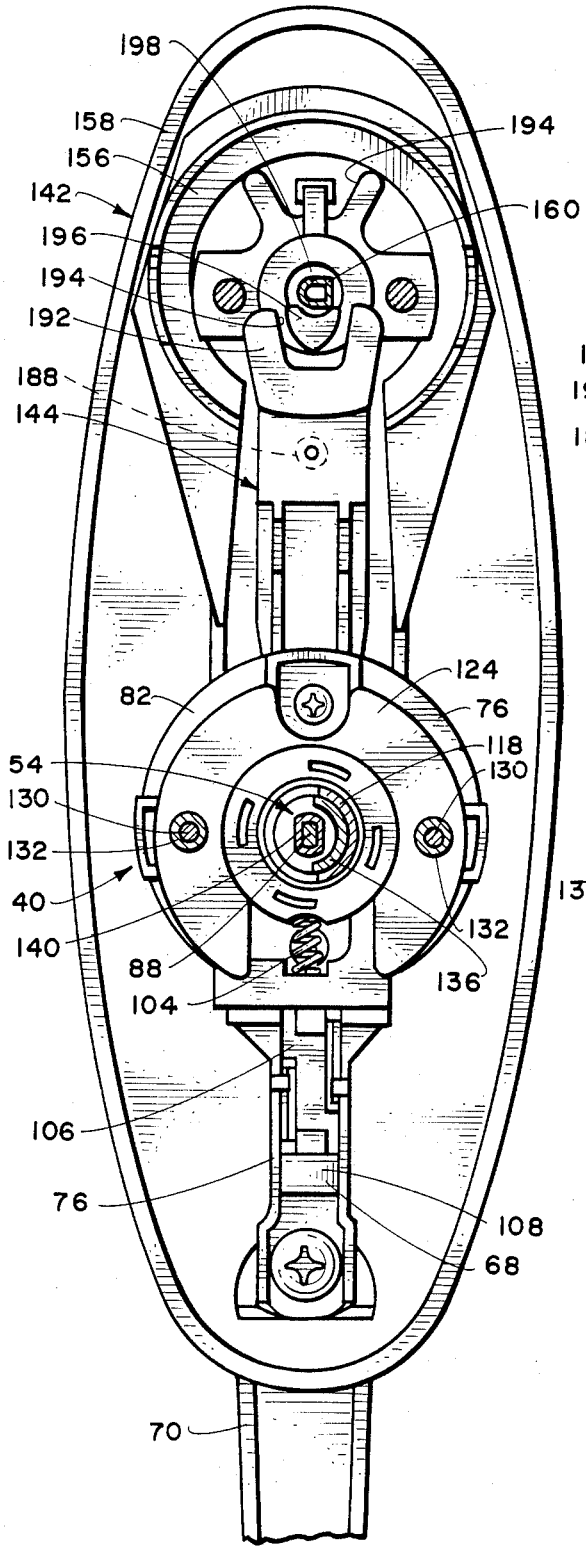
FIG. 27 is a vertical sectional view looking in the direction of the arrows 27—27 in FIG. 24, the first and second latchbolt constructions both being shown in fully locked condition.
Figure 28:
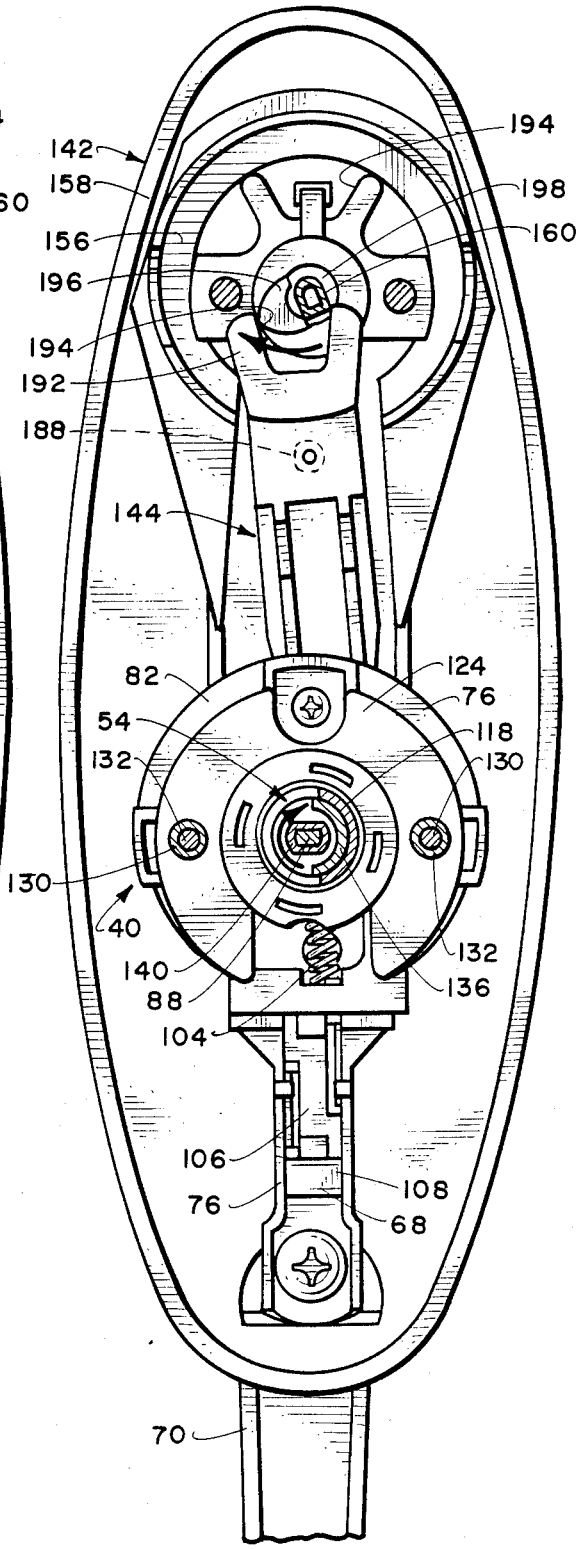
FIG. 28 is a view similar to FIG. 27, but with the exterior operator lock of the second latchbolt construction being unlocked and automatically operating the yoke to place the rack-pinion in engaged position ready for actuation by the thumbpiece of the exterior operator of the first latchbolt construction.

The yoke 144 terminates upwardly in a fork 192 which has a cam opening 194. An upper lock cam 196 lies within the cam opening 194 spaced slightly downwardly from the exterior spindle 160 and having an angular mounting portion 198 received over the exposed end of the lock plug 154 of the deadbolt lock 150. A plug clip 200, as seen in FIGS. 22 and 32, is received engaged with the lock plug 154 and has an upwardly extending engagement portion 202 engaged in a slot 204 of the lock cam mounting portion 198. Thus, the lock cam 196 is pivotal or rotatable with the lock plug 154 and moves from centrally of the yoke fork 192 in either direction of rotation. When the deadbolt 176 is extended, as shown in FIGS. 23 and 27, it engages the yoke fork 192 and pivots the yoke 144 to the left as shown in FIG. 28. When the deadbolt lock 150 is moved oppositely, to disengaged position, it withdraws the deadbolt 176 to the withdrawn position as shown in FIG. 22.

The lower end of the yoke 144 is also formed with a fork 206 providing a slot 208 which receives upwardly therein one of two spaced stub shafts 210 of a lower spindle cap or cam 212, all as shown in FIGS. 21, 24 through 26 and 32. The purpose of providing the two stub shafts 210, one not usable, is for convenience in assembly and is not of importance to the principles of the present invention. Further, the lower spindle cap 212 has a socket 214 formed at an opposite side from the stub shafts 210 and that socket receives the crossbar 86 of the rack cam 84 therein, thereby tying movements of the rack cam 84 to the lower spindle cam 212.

Figure 25:
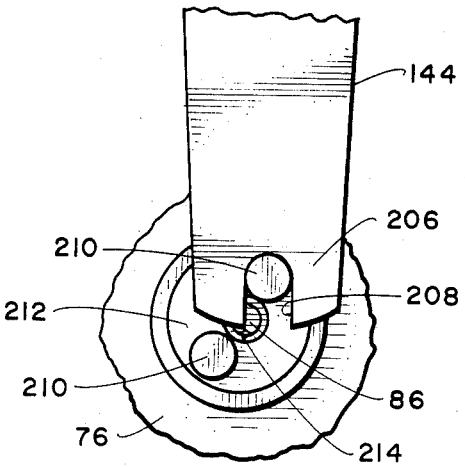
FIG. 25 is an enlarged, vertical sectional view looking in the direction of the arrows 25—25 in FIG. 24 and showing a lower portion of a yoke and a cam for the yoke at the first latch bolt construction and ready for movment.
Figure 26:
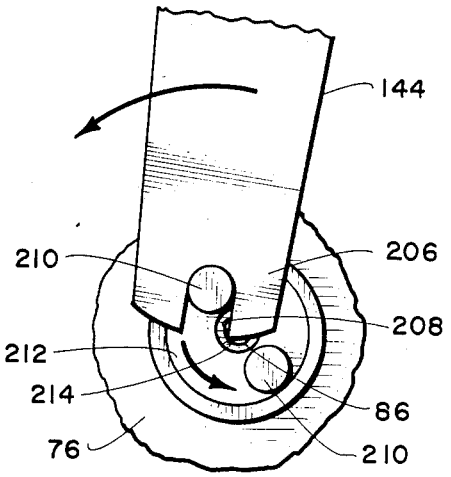
FIG. 26 is a view similar to FIG. 25, but after movement.

Thus, in the resulting movement of the lower yoke fork 206 and its engagement with the lower spindle cam 212 of the rack cam 84, when the upper deadbolt 176 of the second latchbolt construction 142 is extended and the yoke 144 is in the disengaged position as shown in FIG. 27, the relationship of the yoke and the lower spindle cam 212 is as shown in FIG. 25. Insertion of the key 178 with movement to unlock the deadbolt lock 150 with the withdrawing of the deadbolt 176 to the position shown in FIG. 22 causes the upper lock cam 196 to engage and move the upper fork 192 of the yoke 144, as shown in FIG. 28, placing the lower end fork 206 and the lower spindle cam 212 in the position shown in FIG. 26. In view thereof, when the upper deadbolt 176 is in extended locked position, the rack 94 of the rack-pinion construction 66 is spaced away from the pinion 98 thereof, and the operation of the thumbpiece 68 will not effect the pinion, but if the upper deadbolt 176 is withdrawn by actuation of the key 178 in the deadbolt lock 150, the upper lock cam 196 will move the yoke 144 to, in turn, move the lower spindle cam 212, causing the rack cam 84 to shift the rack 94 into engagement with the pinion 98. That downward movement of the thumbpiece 68 will withdraw the biased latchbolt 52 to open the door 42. The locking of the deadbolt lock 150 by the key 178 is just the opposite causing opposite pivotal movement of the yoke 144.

The panic assembly 146 is shown in FIG. 21 through 24 and 29 through 31, and includes a gear sector 216 assembled flatwise with a follower plate 218 by an override bushing 220, the latter to absorb shock loads between the gear sector and follower plate. This assembly is pivotally connected between the first and second latchbolt constructions 40 and 142 at the interior side 48 of the door 42 by a pivot connection 222 and covered by a cover plate 224. As can be best seen, for instance, in FIG. 24, this positioning of the panic assembly 146 at this interior side 48 requires the interior operator 126 of the first latchbolt construction 40 and the interior operator 186 of the second latchbolt construction 142 to be spaced slightly inwardly to permit the added structure, this being different than the similar structure of the first latchbolt construction 40 alone.

The upper edge 226 of the gear sector 216 projects above the follower plate 218 and is formed with a gear surface 228 which is engaged with gear teeth 230 of the pinion 182 and is secured rotatable with the interior spindle 180. The follower plate 218 is formed downwardly spaced below the lower extremeties of the gear sector 216 and below the pivot connection 222 with spaced, downwardly projectingh legs 232 which terminate in lower arcuate engagement surfaces 234, one leg 232 and engagement surface 234 being provided for left-hand constructions and the other for right-hand constructions. Finally, a pair of cam plates 236 each having angled cam surfaces 238 are flat-wise assembled over and rotatable with the cam spindle extension 140 of the interior operator 126. The cam plates are properly positioned including their cam surfaces for properly abutting one of the cam surfaces with one of the engagement surfaces 234 of the follower plate legs 232 to accomplishing the purpose to be hereinafter described. However, the two cam plates with their cam surfaces are likewise planned, one to be used for a left-hand construction and the other to be used for a right-hand construction.

Figure 29:
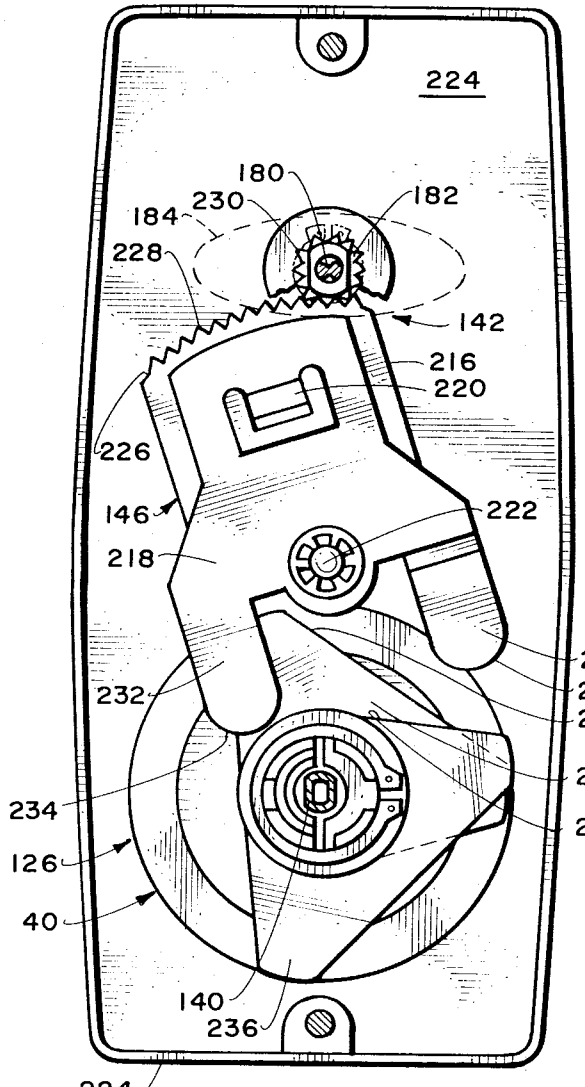
FIG. 29 is a vertical sectional view looking in the direction of the arrows 29—29 in FIG. 24, this view showing the first latchbolt construction in locked condition and the second latchbolt construction in unlocked condition.

In operation, referring to FIG. 29, when the deadbolt 176 of the second latch bolt construction 142 is withdrawn unlocked, the pinion 182 of the panic assembly 146 is at the right-hand end of the gear sector gear surface 228 as shown. At the same time, the appropriate leg 232 of the follower plate 218, that is, the right hand leg, has the engagement surface 234 thereof spaced above the appropriate angled cam surface 238 of its cam plate 236. In this situation, as stated, the upper deadbolt 176 is withdrawn, but the biased latchbolt 52 of the first or lower latchbolt construction 40 is projecting engaged in view of it being a biased latchbolt.

Figure 30:
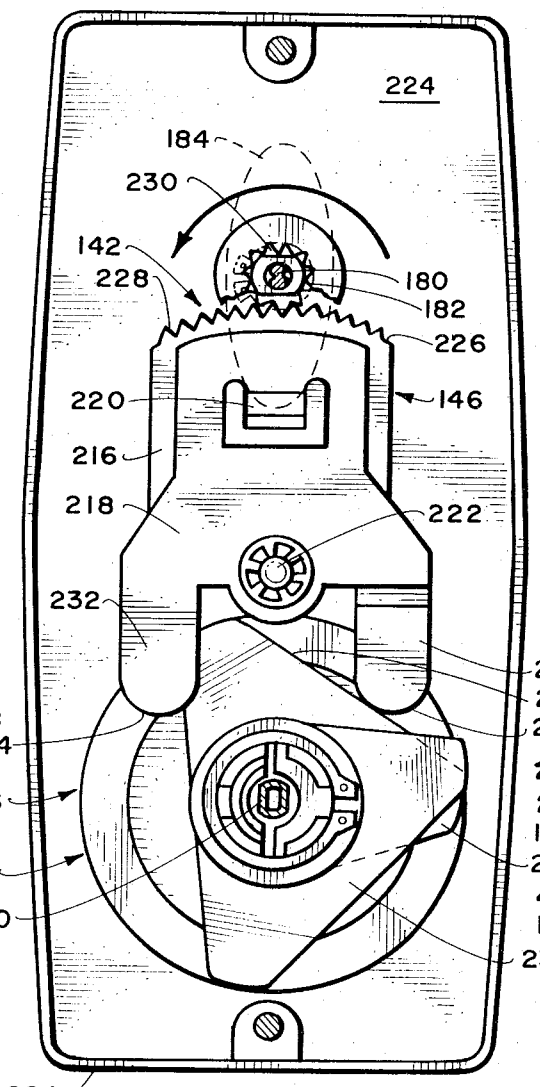
FIG. 30 is a view similar to FIG. 29, but with both the first and second latchbolt constructions in locked condition.

In FIG. 30, the deadbolt 176 of the second or upper latchbolt construction 142 is projected engaged as is seen by the position of the turnpiece 184. This rotates the pinion 182 of the second latchbolt construction 142 along the gear surface 228 of the gear sector 216 moving both the gear sector and the follower plate 218 to an approximate central position. The leg 232 of the follower plate 218 just has the engagement surface 234 touching or nearly touching the angled cam surface 238 of the cam plate 236. Thus, both the biased latchbolt 52 and the deadbolt 176 are in extended locking positions and are not yet governed from a panic situation at this point, that is, they are still operating normally.

Figure 31:
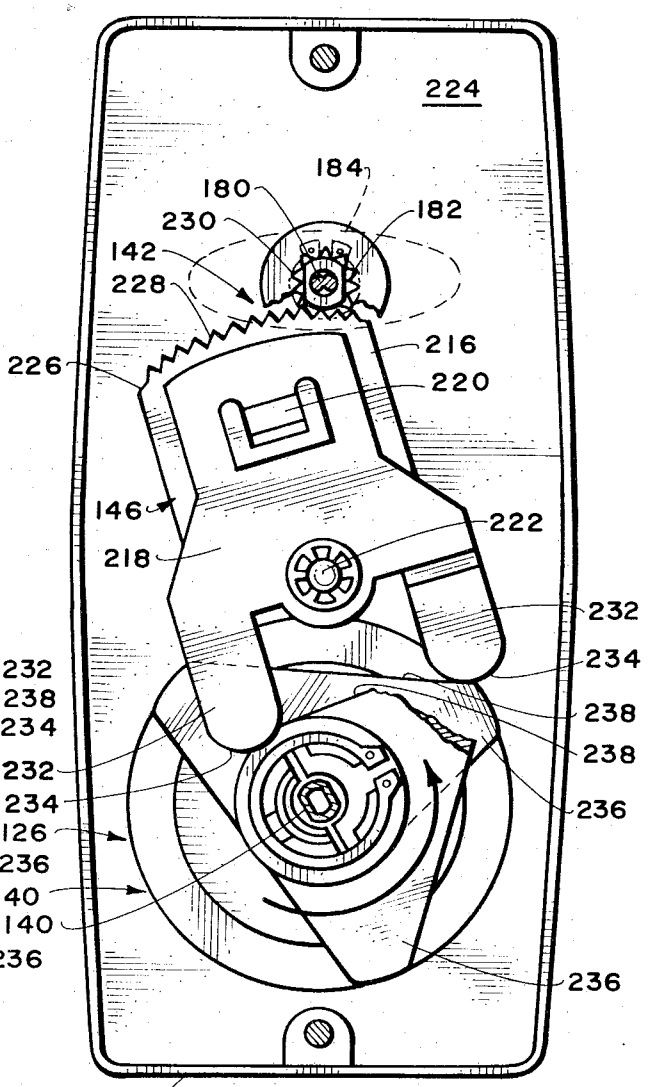
FIG. 31 is a view similar to FIG. 30, but with both of the first and second latchbolt constructions moved to unlocked condition by acutation of the interior operator of the first latchbolt construction.

Referring to FIG. 31, a panic situation has presented itself and the human operator at the inner side of the door 42 has immediately grasped the interior knob 134 of first latchbolt construction 40 and twisted the same to immediately withdraw the biased latchbolt 52 of the first latchbolt construction 40. This not only withdraws the biased latchbolt 52, but through the panic assembly 146 also withdraws the deadbolt 176 in the second latchbolt construction 142. Twisting of the interior knob 134 of the first latchbolt construction 40 causes the cam surface 238 on the cam plate 236 at the interior knob 134 to engage and slide along the engagement surface 234 on the leg 232 of the follower plate 218 so as to progressively move the gear sector 216 and follower plate 218 back to the end starting position. This rotates the pinion 182 for withdrawing the deadbolt 176. Thus, the door 42 may be quickly opened relieving the panic situation, and it should be noted that the rack-pinion construction 66 in the first latchbolt construction 40 is not in any way connected or moved during this procedure, although the deadbolt lock 150 is moved to unlocked position from locked position.

Figure 17:
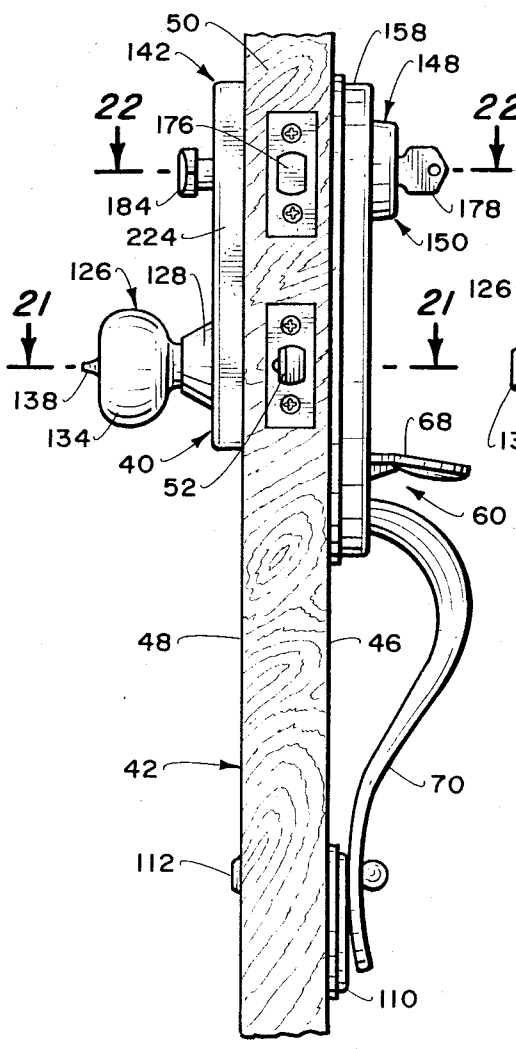
FIG. 17 is a fragmentary, front elevational view of a second embodiment of the latch operating devices of the present invention, this being a double latchbolt construction and being shown with both sides in unlocked condition.

Referring to FIGS. 17 through 20 and starting with FIG. 17, the second embodiment of the latch operating devices of the present invention is shown with the first latchbolt construction 40 unlocked as indicated by the control turnbutton 138 in the interior knob 134. The deadbolt 176 of the second latchbolt construction 142 is withdrawn, this being indicated by the horizontal positioning of the turnpiece 184 at the second latchbolt construction 142. The key 178 is in the deadbolt lock 150, but is in neutral position ready for locking to begin.

Figure 18:
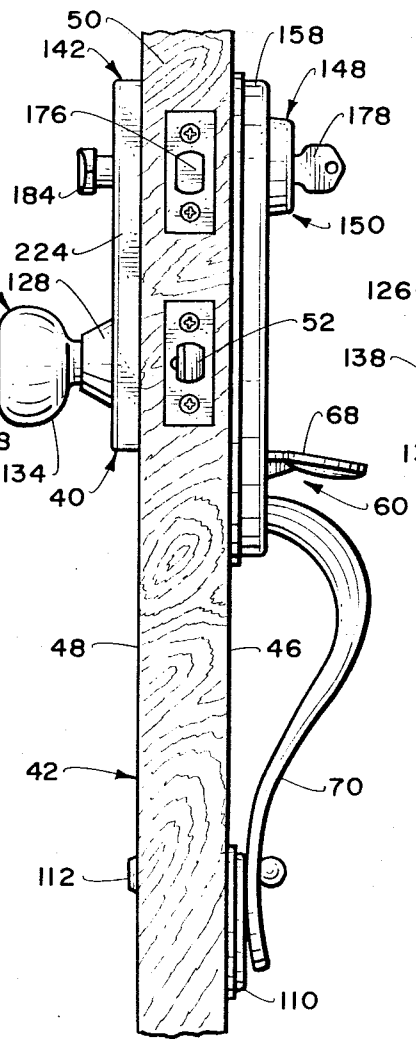
FIG. 18 is a view similar to FIG. 17, but with the first latchbolt construction in locked condition and the second latchbolt construction in unlocked condition.

In FIG. 18, the control turnbutton 138 of the lower interior knob 134 has been turned a quarter-turn to vertical, thereby, through the rack cam 84 operating on the rack 94, separating the rack 94 from the pinion 98 so as to lock the biased latchbolt 52 from the outside by removing any means of actuating the same. The deadbolt 176 of the second latchbolt construction 142 remains unlocked as indicated by the still-horizontal positioning of the turn-piece 184, the key 178 still being positioned ready for a locking operation of the deadbolt lock 150.

Figure 19:
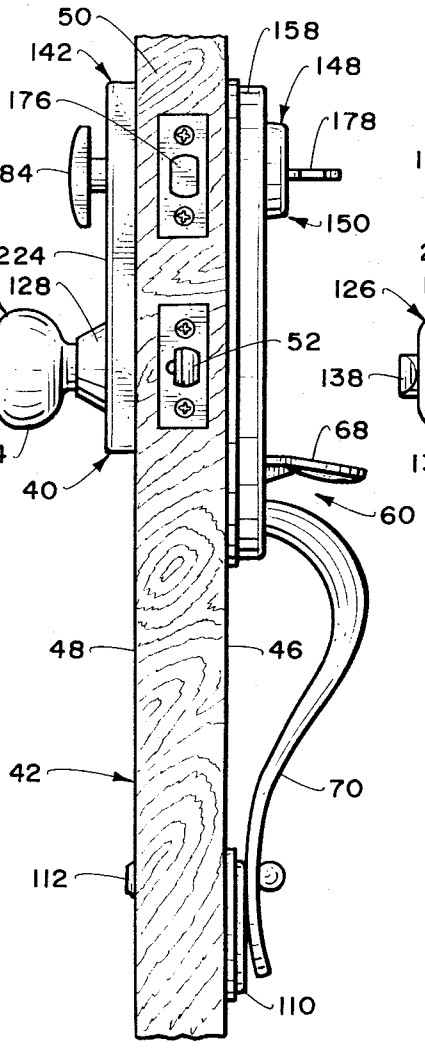
FIG. 19 is a view similar to FIG. 18 with the first latchbolt construction in locked condition, but the second latchbolt also having been just turned to locked condition.

Referring to FIG. 19, the first latchbolt construction 40 remains locked since the interior knob 134 still has the control turnbutton 138 thereof turned vertically which retains the rack 94 separated from the pinion 98 in the rack-pinion construction 66. The rack-pinion construction 66 cannot, therefore, be operated to withdraw the biased latchbolt 52 of this first latchbolt construction 40 and the biased latchbolt remains extended. In the second latchbolt construction 142, however, the deadbolt 176 has been moved from retracted to extended position by turning of the key 178 in the deadbolt lock 150 one-quarter turn, as shown in FIG. 19.

Figure 20:
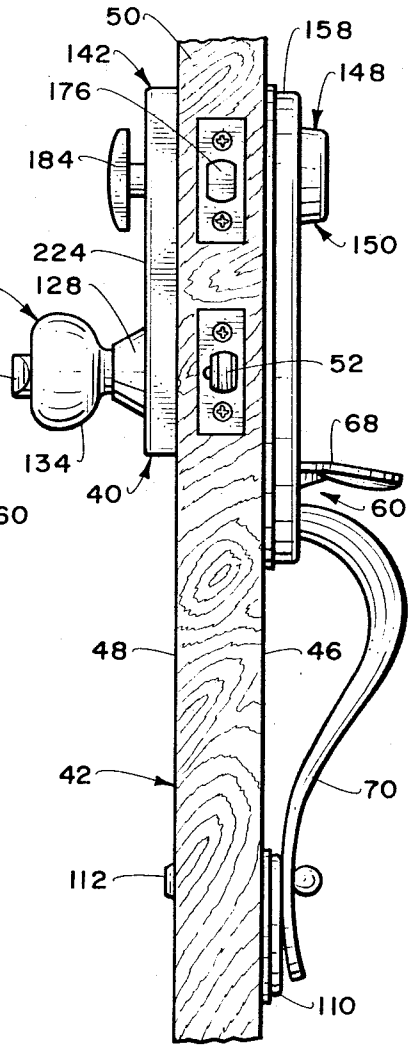
FIG. 20 is a view similar to FIG. 19, but with the key removed from the exterior operator lock of the second latchbolt construction.

In FIG. 20, the first latchbolt construction 40 remains locked, the control turnbutton 138 of the interior knob 134 remains vertical so that the biased latchbolt 52 remains extended, and the rack-pinion construction 66 is separated incapable of withdrawing the biased latchbolt. Furthermore, the deadbolt 176 in the second latchbolt construction 142 remains extended and, therefore, locked, the turnpiece 184 of the interior operator 186 remaining vertical and the key 178 of the deadbolt lock 150 being turned back one-quarter turn to extend vertically and being removed from the deadbolt lock. Due to the usual construction of this form of deadbolt lock 150 as understood by those familiar with this usual form of lock, the one-quarter turn back merely places the key in a position for removal and does not in any way effect the deadbolt 176 for withdrawing the same from its extended or locked position. Thus, both the first latchbolt construction 40 and the second latchbolt construction 142 are fully locked and will remain so until deliberately unlocked.

With the first latchbolt construction 40 and the second latchbolt construction 142 interconnected in the unique manner hereinbefore described, these latchbolt constructions may be locked or unlocked from the exterior side by use of the key 178 in the deadbolt lock 150 of the second latchbolt construction 142. Assume that, as shown in FIG. 17, the deadbolt lock 150 and, therefore, also the turnpiece 184, both of the second latchbolt construction 142, are unlocked with the deadbolt 176 in retracted position. Also assume that the control turn button 138 of the interior knob 134 in the first latchbolt construction 40 is in its unlocked position as shown in FIG. 17 so that, although the biased latchbolt 52 remains spring-urged extended, the rack-pinion construction 66 is joined for operation and can be operated by the thumbpiece 68 to withdraw the biased latchbolt.

Now, to lock both of the biased latchbolt 52 and the deadbolt 176 in extended positions, the key 178 is inserted in the deadbolt lock 150 and turned one-quarter turn into the locked position. This extends the deadbolt 176 of the second latchbolt construction 142 in its extended or locked position. At the same time, due to the yoke 144 connecting between the first and second latchbolt constructions 40 and 142, the yoke through the rack cam 84 moves the rack-pinion construction 66 from its unlocked condition, in which the rack 94 moves the pinion 98 to its unlocked condition, in which the two are separated and the biased latchbolt 52 cannot be withdrawn by the rack-pinion construction 66. This also moves the control turnbutton 138 in the interior knob 134 of the first latchbolt construction 40 from projecting horizontally to projecting vertically. Thus, both the biased latchbolt 52 and the deadbolt 176 are extended and fully locked.

Unlocking the biased latchbolt 52 and the deadbolt 176 is just the opposite, from the outside, and merely consists of an insertion of the key 178 and turning the same one-quarter turn in the unlocking direction. This withdraws the deadbolt 176 of the second latchbolt construction 142 and turns the turnpiece 184 from extending vertically to extending horizontally. Also, through the yoke 144 acting on the rack cam 84, the rack-pinion construction 66 is again brought back to joined unlock condition so that the rack 94 is engaged with the pinion 98. Thus, the thumbpiece 68 will operate the rack-pinion construction 66 and the door 42 may be opened.

Starting from this fully locked condition, the first and second latchbolt constructions 40 and 142 may also be unlocked from the interior side 48. Assuming that the turnpiece 184 of the second latchbolt construction 142 is in locked or vertically extending position as shown in FIG. 20, the deadbolt 176 would be in extended position and could be withdrawn by the turnpiece 184 merely by turning the same. This would have no effect on the first latchbolt construction 40 which could be either locked or unlocked. Locking of the deadbolt 176 from the unlocked position by the turnpiece 184 is just the opposite, and it too would have no effect on the first latchbolt construction 40.

Starting with the deadbolt 176 of the second latchbolt construction 142 in unlocked withdrawn position and the first latchbolt construction 40 in locked position with the control turnbutton 138 of the interior knob 134 extending vertically, this particular positioning being shown in FIG. 18, the biased latchbolt 52 could be withdrawn by merely turning the interior knob 134. Furthermore, the control turnbutton 138 of the interior knob 134 could be turned one-quarter turn to horizontal placing both latchbolt constructions 40 and 142 in the position shown in the position shown in FIG. 17. In this positioning, the biased latchbolt 52 could be withdrawn by depressing the thumbpiece 68 at the exterior side 46. Finally, consider the positioning of both of the biased latchbolt 52 of the first latchbolt construction 40 and the deadbolt 176 of the second latchbolt construction 142 locked and required to be withdrawn from the interior side 48 of the door 42. First, assume that the panic assembly 146 is completely eliminated from the construction. In this case, from the interior side, turning of the interior knob 134 at the first latchbolt construction 40 will withdraw the biased latchbolt 52. Turning of the turnpiece 184 of the second latchbolt construction 142 will move the deadbolt 176 from extended locked position to withdrawn retracted position or the opposite. In other words, at the interior side 48 of the door 42, without the panic assembly 146, neither latchbolt construction movement will effect the other.

With the panic assembly 146, however, assuming both of the first and second latchbolt constructions 40 and 142 are locked as shown in FIG. 20, turning of the interior knob 134 of the first latchbolt construction 40 will not only withdraw the biased latchbolt 52, but also withdraw the deadbolt 176 of the second latchbolt construction 142. Despite this lock positioning, the panic assembly 146 operates from the interior knob 134 of the first latchbolt construction 40 upwardly through the panic assembly 146 into the pinion 182 inwardly of the turnpiece 184 and through the interior spindle 180 directly into the deadbolt lock 150. This withdraws the deadbolt 176 from extended to retracted unlocked position thereby permitting the door to be opened in this panic situation. Movement of the turnpiece 184 of second latchbolt construction 142 will only withdraw the deadbolt 176 and will have no effect on the first latchbolt construction 40.

Although the principles of the present invention have been herein illustrated in particular embodiments of single and double latch operating devices with improved rack-pinion operation and motion transfer structures, it should be kept in mind that these same principles are readily applicable to various other forms of latch operating devices. Thus, it is not intended to limit the latch operating device constructions as disclosed herein to these particular structures alone. The principles of the present invention should be broadly construed and not limited beyond these specific limitations set forth in the appended claims including the patent equivilants thereof.

We claim:

1. In a latch construction of the type mounted on a door or the like having a bolt extendable from the edge of said door, a latch driving mechanism mounted on the door operably connected to said bolt and movable for moving said bolt between extended and retracted positions, an interior operator assembly extending from an interior side of said door and having an interior operator operably connected to said latch driving mechanism actionable for moving said latch driving mechanism to move said bolt; the improvements including: an exterior operator assembly extending from an exterior side of said door and having a pinion and a rack, said pinion being rotatable about a stationary axis and being operably connected to said latch driving mechanism actionable for moving said bolt, said rack being slidable along said pinion engaged therewith to rotate said pinion in unlocked condition and slidable along said pinion but shifted to be spaced transversely therefrom in locked condition, a pivotal thumbpiece operable connected to said rack for sliding said rack along said pinion in either of said shifted unlocked and locked conditions; control means extending from said interior operator to said rack of said exterior operator, said control means having a control cam operably connected to said rack for shifting said rack from said interior operator between said unlocked and locked conditions.

2. In a latch construction as defined in claim 1 in which said control means includes a spindle extending from said interior operator independently rotatable from said interior operator and having said control cam at an exterior end portion operably connected to said rack.

3. In a latch construction as defined in claim 1 in which said interior operator is a rotatably mounted knob operably connected to said latch driving mechanism; and in which said control means is a spindle rotatably mounted relative to said knob and having a turn button centrally of said knob, said spindle extending to said rack of said exterior operator and having said control cam operably connected to said rack.

4. In a latch construction as defined in claim 1 in which said cam of said control means is received in a cam housing and said cam housing is mounted on said rack, said cam shifting said cam housing and said cam housing shifting said rack.

5. In a latch construction as defined in claim 1 in which said cam of said control means is received in a cam housing with control members of said cam housing abutting said cam and determining rotative positioning of said cam, said cam housing abutting said rack, said cam shifting said cam housing and said cam housing shifting said rack.

6. In a latch construction as defined in claim 1 in which said thumbpiece is operably connected to said rack through a slidable rack extension between said thumbpiece and said rack.

7. In a latch construction as defined in claim 1 in which said exterior operator assembly includes a lock operably connected to said control means cam for moving said cam to shift said rack between said unlocked and locked conditions.

8. In a latch construction as defined in claim 7 in which said lock is operably connected to said control means cam through a cross bar abutment between said lock and said cam.

9. In a latch construction as defined in claim 1 in which said control means includes a spindle extending from said interior operator and having said cam thereon at said rack, said cam being received in a cam housing at said rack and said cam housing being operably connected to said rack, said cam shifting said cam housing and said cam housing shifting said rack.

10. In a latch construction as defined in claim 1 in which said control means includes a spindle extending from said interior operator and having said cam thereon at said rack, said cam being received in a cam housing at said rack and said cam housing being operably connected to said rack, said cam shifting said cam housing and said cam housing shifting said rack; and in which said exterior operator assembly includes a lock operably connected to said control means cam for moving said cam to shift said rack between said unlocked and locked conditions.

11. In a latch construction as defined in claim 1 in which said interior operator is a rotatable knob; and in which said control means includes a rotatable spindle extending from said cam at said rack to a turn button mounted centrally of said interior knob and rotatable relative thereto, said turn button being secured to said spindle and said cam being secured to said spindle, said cam being received in a cam housing which is operably connected to said rack, said cam shifting said cam housing and said cam housing shifting said rack.

12. In a latch construction as defined in claim 1 in which said interior operator is a rotatable knob; in which said control means includes a rotatable spindle extending from said cam at said rack to a turn button mounted centrally of said interior knob and rotatable relative thereto, said turn button being secured to said spindle and said cam being secured to said spindle, said cam being received in a cam housing which is operably connected to said rack, said cam shifting said cam housing and said cam housing shifting said rack; and in which said exterior operator assembly includes a lock operably connected to said control means cam for moving said cam to shift said rack between said unlocked and locked conditions.

13. In a latch construction as defined in claim 1 in which said interior operator is a rotatable knob; in which said control means includes a rotatable spindle extending from said cam at said rack to a turn button mounted centrally of said interior knob and rotatable relative thereto, said turn button being secured to said spindle and said cam being secured to said spindle, said cam being received in a cam housing which is operably connected to said rack, said cam shifting said cam housing and said cam housing shifting said rack; and in which said thumbpiece is operably connected to said rack through a slidable rack extension between said thumbpiece and said rack.

14. In a latch construction as defined in claim 1 in which said latch construction is a first latch construction and there is a second latch construction for mounting on said door and the like having a bolt extendable from the edge of said door spaced from said first latch construction bolt, a latch driving mechanism for said second latch construction mounted on said door operably connected to said second latch construction bolt and movable for moving said bolt between extended and retracted positions, an exterior operator assembly for said second latch construction having a lock thereon operably connected to said latch driving mechanism of said second latch construction for moving said second latch construction bolt between extended and retracted positions; and in which a pivotal yoke is operably connected between said second latch construction lock and said first latch construction control means cam, said yoke being pivotal upon movement of said second latch construction lock from locked to unlocked positions to move said control means cam shifting said rack from said locked to said unlocked condition when said rack is in said locked condition.

15. In a latch construction as defined in claim 14 in which said second latch construction includes an interior operator assembly having an interior operator operably connected to said latch driving mechanism of said second latch construction actionable for moving said second latch construction bolt between said extended and retracted positions, said interior operator of said second latch construction simultaneously moving said exterior operator assembly lock between said extended and retracted positions but being free of moving said yoke.

16. In a latch construction as defined in claim 14 in which said yoke is operably connected to said first latch construction cam by a fork and is operably connected to said second latch construction lock by a fork.

17. In a latch construction as defined in claim 14 in which said yoke is operably connected to said second latch construction through a fork on said yoke transversely engaging a cam rotatably movable by said lock.

18. In a latch construction as defined in claim 14 in which said yoke is operably connected to said first latch construction cam by a fork on said yoke transversely engaging a cam rotatable on said exterior operator assembly of said first latch construction.

19. In a latch construction as defined in claim 14 in which said yoke is operably connected to said second latch construction by a fork which transversely engages a cam secured to a torque blade of said lock; and in which said yoke is operably connected to said first latch construction by a fork transversely engaging a cam which is secured to a spindle having said control means cam formed thereon.

20. In a latch construction as defined in claim 14 in which said yoke is operably connected to said first latch construction cam by a fork and is operably connected to said second latch construction lock by a fork; and in which said second latch construction includes an interior operator assembly having an interior operator operably connected to said latch driving mechanism of said second latch construction actionable for moving said second latch construction bolt between said extended and retracted positions, said interior operator of said second latch construction simultaneously moving said exterior operator assembly lock between said extended and retracted positions but being free of moving said yoke.

21. In a latch construction as defined in claim 14 in which said yoke is operably connected to said second latch construction by a fork which transversely engages a cam secured to a torque blade of said lock; in which said yoke is operably connected to said first latch construction by a fork transversely engaging a cam which is secured to a spindle having said control means cam formed thereon; and in which said second latch construction includes an interior operator assembly having an interior operator operably connected to said latch driving mechanism of said second latch construction actionable for moving said second latch construction bolt between said extended and retracted positions, said interior operator of said second latch construction simultaneously moving said exterior operator assembly lock between said extended and retracted positions but being free of moving said yoke.

22. In a latch construction as defined in claim 14 in which panic assembly means is mounted extending between said latch constructions operably connected to at least said latch driving mechanism of said second latch construction and said interior operator of said first latch constuction, said panic assembly means transmitting movement from said interior operator of said first latch construction to at least said latch driving mechanism of said second latch construction for moving said second latch construction bolt from extended to retracted position when said bolt is in said extended position, said panic assembly means being free of transmitting motion from said second latch construction to said first latch construction.

23. In a latch construction as defined in claim 22 in which said second latch construction includes an interior operator assembly having an interior operator operably connected to said latch driving mechanism and said lock of said second latch construction, said interior operator of said second latch construction moving said second latch construction bolt between said extended and retracted positions but being free of having any effect on said first latch construction through said panic assembly means.

24. In a latch construction as defined in claim 22 in which said panic assembly means is operably connected to said latch driving mechanism of said second latch construction through a gear sector on said panic assembly means operably engaged with a pinion operably connected to said latch driving mechanism of said second latch construction.

25. In a latch construction as defined in claim 22 in which said panic assembly means is operably connected to said interior operator of said first latch construction through an arcuate surface on said panic assembly means abutting an angled cam surface connected to said interior operator of said first latch construction, said angled cam surface pivoting said arcuate surface to actuate said panic assembly means.

26. In a latch construction as defined in claim 22 in which said panic assembly means is operably connected to said latch driving mechanism of said second latch construction through a gear sector on said panic assembly means operably engaged with a pinion operably connected to said latch driving mechanism of said second latch construction; and in which said panic assembly means is operably connected to said interior operator of said first latch construction through an arcuate surface on said panic assembly means abutting an angled cam surface connected to said interior operator of said first latch construction, said angled cam surface pivoting said arcuate surface to actuate said panic assembly means.

27. In a latch construction as defined in claim 22 in which said panic assembly means is operably connected to said interior operator of said first latch construction by a pair spaced arcuate surfaces on said panic assembly means each engagable with separate angled cam surfaces connected to said interior operator of said first latch construction, one of said arcuate surfaces on said panic assembly means and its angled cam surface being operable separately from the other of said arcuate surface and angled cam surface depending on the direction of rotation of said first latch construction, adjustment means for setting said direction of rotation of said first latch construction.

28. In a latch construction as defined in claim 22 in which said second latch construction is a deadbolt construction having a deadbolt movable by said latch driving mechanism to an extended position and remaining in said extended position until moved to said retracted position, said deadbolt remaining in said retracted position until once again moved to extended position; in which said panic assembly means is operably connected to said latch driving mechanism of said second latch construction through a gear sector on said panic assembly means operably engaged with a pinion operably connected to said latch driving mechanism of said second latch construction; in which said panic assembly means is operably connected to said interior operator of said first latch construction through an arcuate surface on said panic assembly means abutting an angled cam surface connected to said interior operator of said first latch construction, said angled cam surface pivoting said arcuate surface to actuate said panic assembly means; and in which said second latch construction includes an interior operator assembly having an interior operator operably connected to said latch driving mechanism and said lock of said second latch construction, said interior operator of said second latch construction moving said second latch construction deadbolt between said extended and retracted positions but being free of having an effect on said first latch construction through said panic assembly means.

29. In a latch construction as defined in claim 14 in which said yoke is operably connected to said first latch construction cam by a fork and is operably connected to said second latch construction lock by a fork; in which said second latch construction is a deadbolt construction having a deadbolt movable by said latch driving mechanism to an extended position and remaining in said extended position until moved to said retracted position, said deadbolt remaining in said retracted position until once again moved to extended position; and in which said second latch construction includes an interior operator assembly having an interior operator operably connected to said latch driving mechanism and said lock of said second latch construction, said interior operator of said second latch construction moving said second latch construction deadbolt between said extended and retracted positions but being free of having an effect on said first latch construction through said panic assembly means.

30. In a latch construction as defined in claim 14 in which said second latch construction is a deadbolt construction having a deadbolt movable by said latch driving mechanism to an extended position and remaining in said extended position until moved to said retracted position, said deadbolt remaining in said retracted position until once again moved to extended position; in which said yoke is operably connected to said second latch construction by a fork which transversely engages a cam secured to a torque blade of said lock; in which said yoke is operably connected to said first latch construction by a fork transversely engaging a cam which is secured to a spindle having said control means cam formed thereon; in which said panic assembly means is operably connected to said latch driving mechanism of said second latch construction through a gear sector on said panic assembly means operably engaged with a pinion operably connected to said latch driving mechanism of said second latch construction; in which said panic assembly means is operably connected to said interior operator of said first latch construction through an arcuate surface on said panic assembly means abutting an angled cam surface connected to said interior operator of said first latch construction, said angled cam surface pivoting said arcuate surface to actuate said panic assembly means; and in which said second latch construction includes an interior operator assembly having an interior operator operably connected to said latch driving mechanism and said lock of said second latch construction, said interior operator of said second latch construction moving said second latch construction deadbolt between said extended and retracted positions but being free of having any effect on said first latch construction through said panic assembly means.

31. In a latch construction as defined in claim 1 in which said latch construction is a first latch construction and there is a second latch construction for mounting on a door and the like having a bolt extendable from the edge of said of said door spaced from said first latch construction bolt, a latch driving mechanism for said second latch construction mounted on said door operably connected to said second latch construction bolt and movable for moving said bolt between extended and retracted positions, an exterior operator assembly for said second latch construction having a lock thereon operably connected to said latch driving mechanism of said second latch construction for moving said second latch construction bolt between extended and retracted positions when unlocked and free of such movement when locked; and in which panic assembly means is mounted extending between said latch constructions operably connected to at least said latch driving mechanism of said second latch construction and said interior operator of said first latch construction, said panic assembly means transmitting movement from said interior operator of said first latch construction to at least said latch driving mechanism of said second latch construction moving said second latch construction bolt from extended to retracted position when said bolt is in said extended position, said panic assembly means being free of transmitting motion from said second latch construction to said first latch construction.

32. In a latch construction as defined in claim 31 in which said second latch construction has an interior operator operably connected to said latch driving mechanism of said second latch construction for moving said second latch construction bolt at least from said extended position to said retracted position, said interior operator of said second latch construction being free of transmitting motion through said panic assembly means to said first latch construction.

33. In a latch construction as defined in claim 31 in which said panic assembly means is operably connected to said latch driving mechanism of said second latch construction by a gear sector on said panic assembly means engaged with a pinion operably connected to said latch driving mechanism of said second latch construction.

34. In a latch construction as defined in claim 31 in which said panic assembly means is operably connected to said interior operator of said first latch construction by an arcuate surface on said panic assembly means in abutment with an angled cam surface operably connected with said interior operator of said first latch construction.

35. In a latch construction as defined in claim 31 in which said panic assembly means is operably connected to said latch driving mechanism of said second latch construction by a gear sector on said panic assembly means engaged with a pinion operably connected to said latch driving mechanism of said second latch construction; and in which said panic assembly means is operably connected to said interior operator of said first latch construction by an arcuate surface on said panic assembly means in abutment with an angled cam surface operably connected with said interior operator of said first latch construction.

36. In a latch construction as defined in claim 31 in which said second latch construction is a deadbolt construction having a deadbolt movable by said latch driving mechanism to an extended position and remaining in said extended position until moved to said retracted position, said deadbolt remaining in said retracted position until once again moved to extended position; in which an interior operator is mounted on said second latch construction and is operable for rotation with said latch driving mechanism, said second latch construction lock in movement from locked to unlocked positions moving said latch driving mechanism of said second latch construction and said interior operator of said second latch construction from locked to unlocked positions, said interior operator of said second latch construction being free of transmitting motion through said panic assembly means to said first latch construction; and in which said panic assembly means is operably connected to said latch driving mechanism of said second latch construction by a gear sector on said panic assembly means engaged with a pinion operably connected to said latch driving mechanism of said second latch construction.

37. In a latch construction as defined in claim 31 in which said second latch construction is a deadbolt construction having a deadbolt movable by said latch driving mechanism to an extended position and remaining in said extended position until moved to said retracted position, said deadbolt remaining in said retracted position until once again moved to extended position; in which an interior operator is mounted on said second construction and is operable for rotation with said latch driving mechanism, said second latch construction lock in movement from locked to unlocked positions moving said latch driving mechanism of said second latch construction and said interior operator of said second latch construction from locked to unlocked positions, said interior operator of said second latch construction being free of transmitting motion through said panic assembly means to said first latch construction; and in which said panic assembly means is operably connected to said interior operator of said first latch construction by an arcuate surface on said panic assembly means in abutment with an angled cam surface operably connected with said interior operator of said first latch construction.

38. In a latch construction as defined in claim 31 in which said second latch construction is a deadbolt construction having a deadbolt movable by said latch driving mechanism to an extended position and remaining in said extended position until moved to said retracted position, said deadbolt remaining in said retracted position until once again moved to exended position; in which an interior operator is mounted on said second latch construction and is operable for rotation with said latch driving mechanism, said second latch construction lock in movement from locked to unlocked positions moving said latch driving mechanism of said second latch construction and said interior oprator of said second latch construction from locked to unlocked positions, said interior operator of said second latch construction being free to transmitting motion through said panic assembly means to said first latch construction; in which said panic assembly means is operably connected to said latch driving mechanism of said second latch construction by a gear sector on said panic assembly means engaged with a pinion operably connected to said latch driving mechanism of said second latch construction; and in which said panic assembly means is operably connected to said interior operator of said first latch construction by an arcuate surface on said panic assembly means in abutment with an angled cam surface operably connected with said interior operator of said first latch construction.

39. In a latch construction as defined in claim 31 in which said panic assembly means is operably connected to said interior operator of said first latch construction by means of spaced arcuate surfaces on said panic assembly means and two angled cam surfaces operably connected to said interior operator of said first latch construction, one of said arcuate surfaces and said angled cam surfaces operating for one direction of rotation and the other for the opposite direction of rotation, there being adjustment means on said angled cam surfaces for adjusting between said directions of rotation.

40. In a latch construction as defined in claim 39 in which said second latch construction has an interior operator operably connected to said latch driving mechanism of said second latch construction for moving said second latch construction bolt at least from said extended position to said retracted position, said interior operator of said second latch construction being free of transmitting motion through said panic assembly means to said first latch construction.

41. In a latch construction as defined in claim 39 in which said second latch construction has an interior operator operably connected to said latch driving mechanism of said second latch construction for moving said second latch construction bolt at least from said extended position to said retracted position, said interior operator of said second latch construction being free of transmitting motion through said panic assembly means to said first latch construction; and in which said panic assembly means is operably connected to said latch driving mechanism of said second latch construction by a gear sector on said panic assembly means engaged with a pinion operably connected to said latch driving mechanism of said second latch construction.

42. In a latch construction as defined in claim 1 in which said latch construction is a first latch construction and there is a second latch construction for mounting on a door and the like having a bolt extendable from the edge of said door spaced from said first latch construction bolt, a latch driving mechanism for said second latch construction mounted on said door operably connected to said second latch construction bolt and movable for moving said bolt between extended and retracted positions, an interior operator assembly for said second latch construction operably connected to said latch driving mechanism of said second latch construction for moving said second latch construction bolt between extended and retracted positions; and in which panic assembly means is mounted extending between said latch constructions operably connected to at least said latch driving mechanism of said second latch construction and said interior operator of said first latch construction, said panic assembly means transmitting movement from said interior operator of said first latch construction to at least said latch driving mechanism of said second latch construction moving said second latch construction bolt from extended to retracted position when said bolt is in said extended position, said panic assembly means being free of transmitting motion from said second latch construction to said first latch construction.

43. In a latch construction as defined in claim 42 in which said panic assembly means is operably connected to said latch driving mechanism of said second latch construction by a gear sector on said panic assembly means engaged with a pinion operably connected to said latch driving mechanism of said second latch construction.

44. In a latch construction as defined in claim 42 in which said panic assembly means is operably connected to said interior operator of said first latch construction by an arcuate surface on said panic assembly means in abutment with an angled cam surface operably connected with said interior operator of said first latch construction.

45. In a latch construction as defined in claim 42 in which said panic assembly means is operably connected to said latch driving mechanism of said second latch construction by a gear sector on said panic assembly means engaged with a pinion operably connected to said latch driving mechanism of said second latch construction; and in which said panic assembly means is operably connected to said interior operator of said first latch construction by an arcuate surface on said panic assembly means in abutment with an angled cam surface operably connected with said interior operator of said first latch construction.

46. In a latch construction as defined in claim 42 in which said second latch construction is a deadbolt construction having a deadbolt movable by said latch driving mechanism to an extended position and remaining in said extended position until moved to said retracted position, said deadbolt remaining in said retracted position until once again moved to extended position; in which said panic assembly means is operably connected to said latch driving mechanism of said second latch construction by a gear sector on said panic assembly means engaged with a pinion operably connected to said latch driving mechanism of said second latch construction; and in which said panic assembly means is operably connected to said interior operator of said first latch construction by an arcuate surface on said panic assembly means in abutment with an angled cam surface operably connected with said interior operator of said first latch construction.

47. In a latch construction as defined in claim 42 in which said panic assembly means is operably connected to said latch driving mechanism of said second latch construction by a gear sector on said panic assembly means engaged with a pinion operably connected to said latch driving mechanism of said second latch construction; and in which said panic assembly means is operably connected to said interior operator of said first latch construction by means of spaced arcuate surfaces on said panic assembly means and two angled cam surfaces operably connected to said interior operator of said first latch construction, one of said arcuate surfaces and said angled cam surfaces operating for one direction of rotation and the other for the opposite direction of rotation, there being adjustment means on said angled cam surfaces for adjusting between said directions of rotation.

48. In a latch construction as defined in claim 42 in which said panic assembly means is operably connected to said interior operator of said first latch construction by means of spaced arcuate surfaces on said panic assembly means and two angled cam surfaces operably connected to said interior operator of said first latch construction, one of said arcuate surfaces and said angled cam surfaces operating for one direction of rotation and the other for the opposite direction of rotation, there being adjustment means on said angled cam surfaces for adjusting between said directions of rotation.

49. In a latch construction as defined in claim 1 in which said latch construction is a first latch construction and there is a second latch construction for mounting on doors and the like with a bolt extendable from said door edge spaced from said first latch construction bolt, a latch driving mechanism for said second latch construction mounted on said door operably connected to said second latch construction bolt and movable for moving said bolt between extended and retracted positions, an exterior operator assembly for said second latch construction having a lock thereon operably connected to said latch driving mechanism of said second latch construction for moving said second latch construction bolt between extended and retracted positions; and in which a pivotal yoke is operably connected between said second latch construction lock and said first latch construction control means cam, said yoke being pivotal upon movement of said second latch construction lock from locked to unlocked positions to move said control means cam shifting said rack from said locked to said unlocked condition when said rack is in said locked condition, said yoke also being pivotal upon movement of said second latch construction lock from unlocked to locked positions to move said control means cam shifting said rack from said unlocked to said locked condition when said rack is in said unlocked condition.

50. In a latch construction as defined in claim 49 in which said second latch construction includes an interior operator assembly having an interior operator operably connected to said latch driving mechanism of said second latch construction actionable for moving said second latch construction bolt between said extended and retracted positions, said interior operator of said second latch construction simultaneously moving said exterior operator assembly lock between said extended and retracted positions but being free of moving said yoke.

51. In a latch construction as defined in claim 49 in which said yoke is operably connected to said first latch construction cam by a fork and is operably connected to said second latch construction lock by a fork.

52. In a latch construction as defined in claim 49 in which said yoke is operably connected to said first latch construction cam by a fork and is operably connected to said second latch construction lock by a fork; and in which said second latch construction includes an interior operator assembly having an interior operator operably connected to said latch driving mechanism of said second latch construction actionable for moving said second latch construction bolt between said extended and retracted positions, said interior operator of said second latch construction simultaneously moving said exterior operator assembly lock between said extended and retracted positions but being free of moving said yoke.

53. In a latch construction as defined in claim 49 in which said yoke is operably connected to said second latch construction by a fork with transversely engages a cam secured to a torque blade of said lock; in which said yoke is operably connected to said first latch construction by a fork transversely engaging a cam which is secured to a spindle having said control means cam formed thereon; and in which said second latch construction includes an interior operator assembly having an interior operator operably connected to said latch driving mechanism of said second latch construction actionable for moving said second latch construction bolt between said extended and retracted positions, said interior operator of said second latch construction simultaneously moving said exterior operator assembly lock between said extended and retracted positions but being free of moving said yoke.

* * * * *